US009552766B2

(12) United States Patent
Kumeta et al.

(10) Patent No.: US 9,552,766 B2
(45) Date of Patent: Jan. 24, 2017

(54) ELECTROLUMINESCENCE DISPLAY DEVICE WITH LIGHT EMISSION CONTROL AND DRIVING METHOD THEREOF

(71) Applicant: SAMSUNG DISPLAY CO., LTD., Yongin, Gyeonggi-Do (KR)

(72) Inventors: Masayuki Kumeta, Yokohama (JP); Takeshi Okuno, Yokohama (JP); Eiji Kanda, Yokohama (JP); Ryo Ishii, Yokohama (JP); Daisuke Kawae, Yokohama (JP)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 11 days.

(21) Appl. No.: 14/468,514

(22) Filed: Aug. 26, 2014

(65) Prior Publication Data

US 2015/0062195 A1 Mar. 5, 2015

(30) Foreign Application Priority Data

Aug. 30, 2013 (JP) ..... 2013-180122

(51) Int. Cl.
*G09G 3/32* (2016.01)

(52) U.S. Cl.
CPC .... *G09G 3/3233* (2013.01); *G09G 2300/0842* (2013.01); *G09G 2300/0861* (2013.01)

(58) Field of Classification Search
CPC ..... G09G 3/3233; G09G 2300/0861; G09G 2300/0842
USPC ..... 345/77, 690
See application file for complete search history.

(56) References Cited

U.S. PATENT DOCUMENTS

| | | | | |
|---|---|---|---|---|
| 7,079,124 | B2 | 7/2006 | Yamazaki et al. | |
| 7,982,694 | B2 | 7/2011 | Ogura et al. | |
| 2003/0178946 | A1 | 9/2003 | Nakamura et al. | |
| 2013/0314454 | A1* | 11/2013 | Jin | G09G 3/3406 345/690 |
| 2014/0340377 | A1* | 11/2014 | Kishi | G09G 3/3225 345/211 |

FOREIGN PATENT DOCUMENTS

| | | | |
|---|---|---|---|
| JP | 2002-358049 | A | 12/2002 |
| JP | 2004-139042 | A | 5/2004 |
| JP | 2005-031635 | A | 2/2005 |
| JP | 2009-133914 | A | 6/2009 |
| JP | 2009-258227 | A | 11/2009 |
| JP | 2012-098707 | A | 5/2012 |

* cited by examiner

*Primary Examiner* — Jonathan Blancha
(74) *Attorney, Agent, or Firm* — Lee & Morse, P.C.

(57) ABSTRACT

An electroluminescence display device includes a controller which generates signals for controlling at least one pixel circuit during a first period and a second period. The controller controls current to a light-emitting element of the at least one pixel circuit based on a data voltage in the first period. The controller controls a supplying period of current to the light-emitting element based on a duty control voltage in the second period. The supplying period when the pixel circuit is driven at a first gray scale value is longer than that when the pixel circuit is driven at a second gray scale. The first gray scale value is greater than the second gray scale value.

20 Claims, 27 Drawing Sheets

DT = VDATA
INI = OFF Level (High)
SCAN = ON Level (Low)
EM = OFF Level (High)

DT = VDUTY
INIT = OFF Level (High)
SCAN = ON Level (Low)
EM = OFF Level (High)

DT = VDATA or VDUTY
INIT = OFF Level (High)
SCAN = OFF Level (High)
EM = ON Level (Low)

DT = VRES
INIT = OFF Level (High)
SCAN = ON Level (Low)
EM = OFF Level (High)

DT = VDATA
INIT = OFF Level (High)
SCAN = ON Level (Low)
EM = OFF Level (High)

DT = VDUTY
INIT = OFF Level (High)
SCAN = ON Level (Low)
EM = OFF Level (High)

DT = VDUTY(High)
INIT = OFF Level (High)
SCAN = ON Level (Low)
EM = OFF Level (High)

DT = VDATA or VDUTY
INIT = OFF Level (High)
SCAN = OFF Level (High)
EM = ON Level (Low)

ELECTROLUMINESCENCE DISPLAY DEVICE WITH LIGHT EMISSION CONTROL AND DRIVING METHOD THEREOF

CROSS-REFERENCE TO RELATED APPLICATION

Japanese Application No. 2013-180122, filed on Aug. 30, 2013, and entitled, "Electroluminescence Display Device and Driving Method Thereof," is incorporated by reference herein in its entirety.

BACKGROUND

1. Field

One or more embodiments described herein relate to an electroluminescence display device and method of driving such a device.

2. Description of the Related Art

One type of display device uses electroluminescence (EL) light-emitting elements to generate images. Each EL element generates light based on a supplied current. The luminance of light tends to vary based on the transistor characteristics of each pixel. For example, variations in the threshold voltage of the driving transistor of each pixel may cause differences in luminance, which adversely affects display quality.

Attempts have been made to correct (or, compensate) variances in the threshold voltages of the driving transistors. However, if the current supplied to each EL element decreases, for example, as a result of increasing display resolution, correction may not be achieved. In particular, non-uniformity in a displayed image may be intensified at low gray scale values (e.g., small current regions) because the characteristics of the EL elements substantially vary at these values. The degradation in luminance increases when maximum current supplied to the EL elements.

SUMMARY

In accordance with one embodiment, an electroluminescence display device includes a plurality of pixel circuits, each of the pixel circuits including a light-emitting element to emit light based on a supplied current, a driving transistor to supply the current to the light-emitting element based on a potential of a gate terminal of the driving transistor, a sampling switch to sample a data voltage corresponding to image data at the gate terminal of the driving transistor, a switch transistor to place the driving transistor in a diode-connected state, and a capacitive element to store a potential of the gate terminal of the driving transistor.

One vertical period in which each of the pixel circuits is driven includes a current gray scale control period and a duty gray scale control period, in the current gray scale control period the current to be supplied to the light-emitting element is controlled based on the data voltage, and in the duty gray scale control period a supplying period of the current provided to the light-emitting element is controlled based on a duty control voltage. The data voltage and the duty control voltage are supplied to a source terminal of the driving transistor in the driving transistor diode-connected state. The duty control voltage has two voltage values. The supplying period of the current provided to the light-emitting element when each of the pixel circuits is driven at a first gray scale value is longer than that when each pixel circuit is driven at a second gray scale, the first gray scale value being greater than the second gray scale value.

The device may include a plurality of control lines arranged in a row direction, the control lines to supply control signals for controlling transistors in respective ones of the pixel circuits; and a plurality of signal lines arranged in a column direction, the signal lines to supply data voltages and duty control voltages to respective ones of the pixel circuits. The pixel circuits may be arranged in a matrix and are connected to corresponding control lines and corresponding signal lines. Operations which include initializing the gate terminal of the driving transistor and the potential of the capacitive element, correcting a threshold voltage of the driving transistor, programming data at the gate terminal of the driving transistor, and controlling a duty period of the driving transistor may be line-sequentially performed for each of the pixel circuits. A light-emitting timing and a non-light-emitting timing of the light-emitting element may be different for the pixel circuits.

The device may include a plurality of control lines arranged in a row direction, the control lines to supply control signals for controlling transistors in respective ones of the pixel circuits; and a plurality of signal lines arranged in a column direction, the signal lines to supply data voltages and duty control voltages to respective ones of the pixel circuits.

The pixel circuits may be arranged in a matrix form and are connected to corresponding control lines and corresponding signal lines. Operations which include initializing the gate terminal of the driving transistor and the potential of the capacitive element and correcting a threshold voltage of the driving transistor are simultaneously performed for each of the pixel circuits, and operations of programming data at the gate terminal of the driving transistor and controlling a duty period of the driving transistor may be line-sequentially performed for each of the pixel circuits. A light-emitting timing and a non-light-emitting timing of the light-emitting element may be different for the pixel circuits.

The current gray scale control period may be substantially equal to the duty gray scale control period. The duty gray scale control period may include a plurality of sub-frames, and the supplying period of the current provided to the light-emitting element based on the duty control voltage may be controlled every sub-frame. The current gray scale control period may be substantially equal to a period of each sub-frame of the duty gray scale control period.

In accordance with another embodiment, a method for driving an electroluminescence display device includes controlling a current for a light-emitting element based on a data voltage and a supplying period of a current for the light-emitting element based on a duty control voltage, during one vertical period in which at least one pixel circuit is driven; and supplying the data voltage and the duty control voltage to a source terminal of a driving transistor of the at least one pixel circuit when the driving transistor is in a diode-connected state, wherein the duty control voltage has two voltage values, and wherein the supplying period of the current for the light-emitting element when the at least one pixel circuit is driven at a first gray scale value is longer than the supplying period when the at least one pixel circuit is driven at a second gray scale value less than the first gray scale value. One vertical period in which each of the pixel circuits is driven may include a current gray scale control period and a duty gray scale control period, in the current gray scale control period the current to be supplied to the light-emitting element may be controlled based on the data voltage, and in the duty gray scale control period a supplying period of the current provided to the light-emitting element may be controlled based on a duty control voltage.

The method may include supplying control signals for controlling transistors of a plurality of pixel circuits; and supplying data voltages and duty control voltages to the pixel circuits, the pixel circuits arranged in a matrix and connected to corresponding control lines and corresponding signal lines. The method may further include line-sequentially performing operations which include initializing a gate terminal of the driving transistor and a potential of the capacitive element, correcting a threshold voltage of the driving transistor, programming data at the gate terminal of the driving transistor, and controlling a duty period of the driving transistor for each of the pixel circuits, wherein a light-emitting timing and a non-light-emitting timing of light-emitting elements of the pixel circuits are different.

The method may include supplying control signals for controlling transistors in a plurality of pixel circuits; and supplying the data voltage and the duty control voltage to each of the pixel circuits, the pixel circuits arranged in a matrix and connected to corresponding control lines and corresponding signal lines. The method may further include simultaneously performing operations which include initializing the gate terminal of the driving transistor and the potential of the capacitive element and correcting a threshold voltage of the driving transistor for each of the pixel circuits, and line-sequentially performing operations which include programming data at the gate terminal of the driving transistor and controlling a duty period of the driving transistor for each of the pixel circuits, wherein a light-emitting timing and a non-light-emitting timing of the light-emitting element are different for the pixel circuits.

The current gray scale control period may be substantially equal to the duty gray scale control period. The duty gray scale control period may includes a plurality of sub-frames, and the supplying period of the current provided to the light-emitting element based on the duty control voltage may be controlled every sub-frame. The current gray scale control period may be substantially equal to a period of each sub-frame of the duty gray scale control period.

In accordance with another embodiment, an apparatus includes an interface and a controller coupled to the interface, the controller to control at least one pixel circuit during a first period and a second period, wherein the controller is to control current to a light-emitting element of the at least one pixel circuit based on a data voltage in the first period, wherein the controller is to control a supplying period of current to the light-emitting element based on a duty control voltage in the second period, and wherein the supplying period when the pixel circuit is driven at a first gray scale value is longer than that when the pixel circuit is driven at a second gray scale, the first gray scale value being greater than the second gray scale value.

The data voltage and the duty control voltage may be supplied to a source terminal of a driving transistor of the pixel circuit when the driving transistor is in a diode-connected state. The first period may be substantially equal to the second period. The first period may be substantially equal to a period of a sub-frame in the second period.

The controller may line-sequentially control operations which include initializing a gate terminal of a driving transistor and a potential of a capacitive element of the at least one pixel circuit, correcting a threshold voltage of the driving transistor, programming data at the gate terminal of the driving transistor, and controlling a duty period of the driving transistor.

The at least one pixel circuit may include a plurality of pixel circuits, and a light-emitting timing and a non-light-emitting timing may be different for the pixel circuits. The controller may simultaneously control operations which include initializing a gate terminal of a driving transistor and a potential of a capacitive element, and correcting a threshold voltage of the driving transistor of each of a plurality of pixel circuits. The controller may line-sequentially control operations which include programming data at the gate terminal of the driving transistor and controlling a duty period of the driving transistor of each of the pixel circuits. The second period may include a plurality of sub-frames, and the supplying period of the current to the light-emitting element based on the duty control voltage may be controlled every sub-frame.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
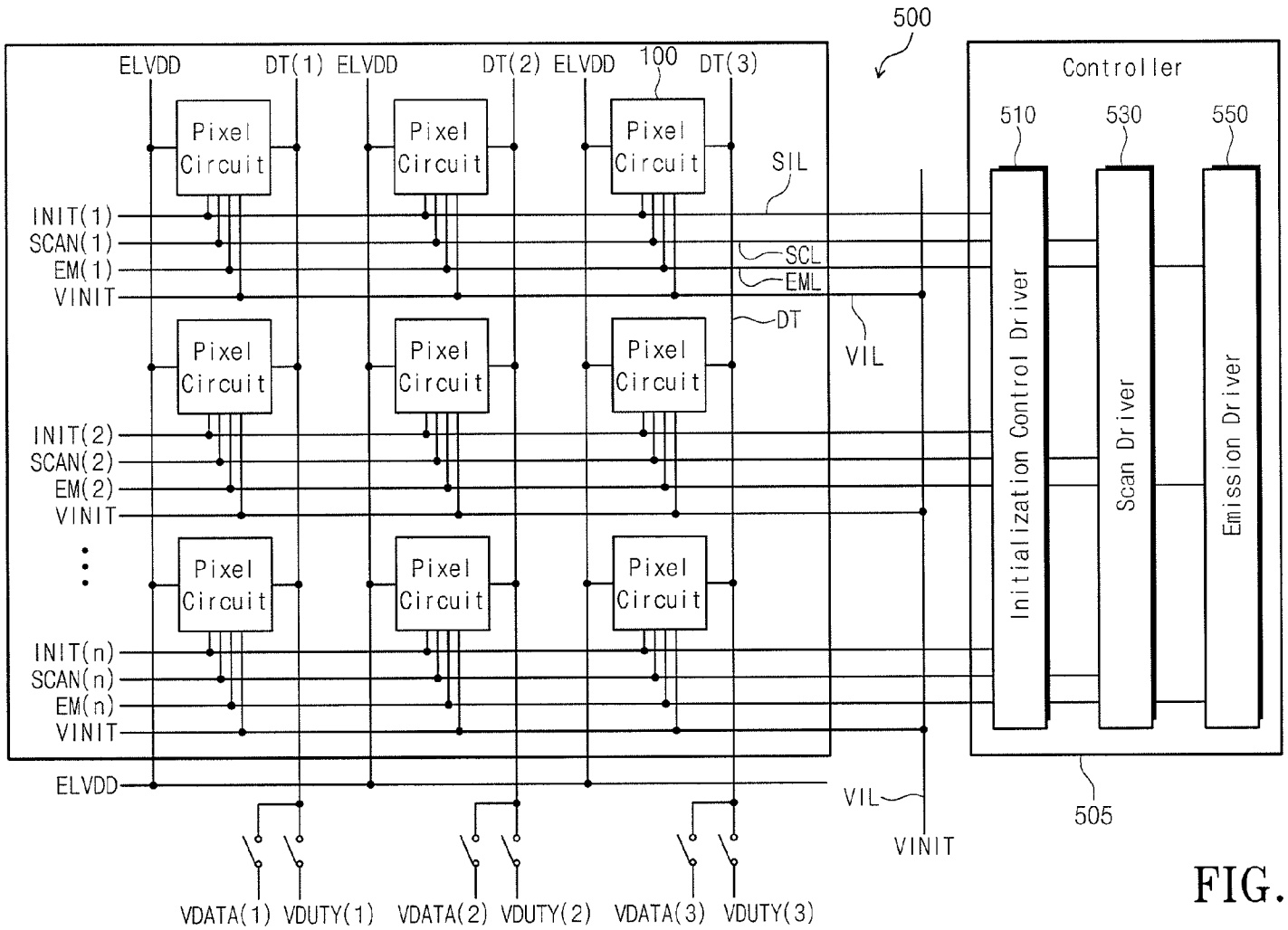
FIG. 1 illustrates an embodiment of an EL display device.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art.

In the drawing figures, the dimensions of layers and regions may be exaggerated for clarity of illustration. It will also be understood that when a layer or element is referred to as being "on" another layer or substrate, it can be directly on the other layer or substrate, or intervening layers may also be present. Further, it will be understood that when a layer is referred to as being "under" another layer, it can be directly under, and one or more intervening layers may also be present. In addition, it will also be understood that when a layer is referred to as being "between" two layers, it can be the only layer between the two layers, or one or more intervening layers may also be present. Like reference numerals refer to like elements throughout.

It will be understood that when an element or layer is referred to as being "on", "connected to", "coupled to", or "adjacent to" another element or layer, it can be directly on, connected, coupled, or adjacent to the other element or layer, or intervening elements or layers may be present. In contrast, when an element is referred to as being "directly on," "directly connected to", "directly coupled to", or "immediately adjacent to" another element or layer, there are no intervening elements or layers present.

FIG. 1 illustrates an embodiment of an electroluminescence (EL) display device 500 which may be used as a display unit of an electronic device, such as but not limited to a television, a smart phone, a handheld telephone, and a personal computer. The EL display device 500 includes a plurality of pixel circuits 100 arranged in a matrix and a controller 505 which includes an initialization control driver 510, a scan driver 530, and an emission driver 550. The controller 505 generates signals for controlling the pixel circuits 100. The signals are sent through an interface, which, for example, may be one or more outputs of a chip including the controller or the signal lines to be discussed in greater detail below.

The EL display device 500 displays images through light-emitting elements (EL element) in the pixel circuits 100. In one embodiment, each EL element may be an organic EL element such as an organic light-emitting diode (OLED). In another embodiment, the EL element may be different from an OLED, e.g., one having a rectification characteristic.

The pixel circuits 100 are connected to signal lines DT that provide image data. The pixel circuits 100 extend in a column direction and are also connected to power lines GL that provide a power supply voltage ELVDD to the pixel circuits 100 for light-emission. The power lines GL also extend in the column direction. Lower ends of the power lines GL are commonly connected to receive the power supply voltage ELVDD.

The pixel circuits 100 are arranged in n rows and m columns (e.g., an n×m matrix). The pixel circuits 100 are connected to corresponding signal lines DT and corresponding power lines GL.

Control lines SIL extend in a row direction and are connected to the initialization control driver 510. Scan lines SCL extend in the row direction and are connected to the scan driver 530. Light-emitting control lines EML extend in the row direction and are connected to the emission driver 550. Initialization voltage lines VIL also extend in the row direction. First ends of the initialization voltage lines VIL are commonly connected.

The pixel circuits 100 are connected to corresponding control lines SIL, scan lines SCL, light-emitting control lines EML, and initialization voltage lines VIL by on a row-by-row basis. Transistors in the pixel circuits 100 are controlled by control signals from the control lines SIL, scan lines SCL, and light-emitting control lines EML.

The initialization control driver 510 outputs initialization control signals INIT through the control lines SIL. The scan driver 530 outputs scan signals SCAN through the scan lines SCL. The emission driver 550 outputs light-emitting control signals EM through the light-emitting control lines EML. The initialization voltage lines VIL receive an initialization voltage VINIT in common.

The EL display device 500 may include a control unit and a power supply unit. The control unit may including a central processing unit (CPU) or other processing device, a memory, and so on, for controlling operations of the EL display device 500. For example, the control unit may control the initialization control driver 510, the scan driver 530, and the emission driver 550. The control unit may also provide the pixel circuits 100 with data voltages and duty control voltages through the signal lines DT.

The power supply unit supplies power to the EL display device 500 and, optionally, various components of an electronic device which includes the EL display device 500. The power supply unit may supply the EL element of each pixel circuit 100 with an anode voltage ELVDD and a cathode voltage ELVSS.

Figure 2:
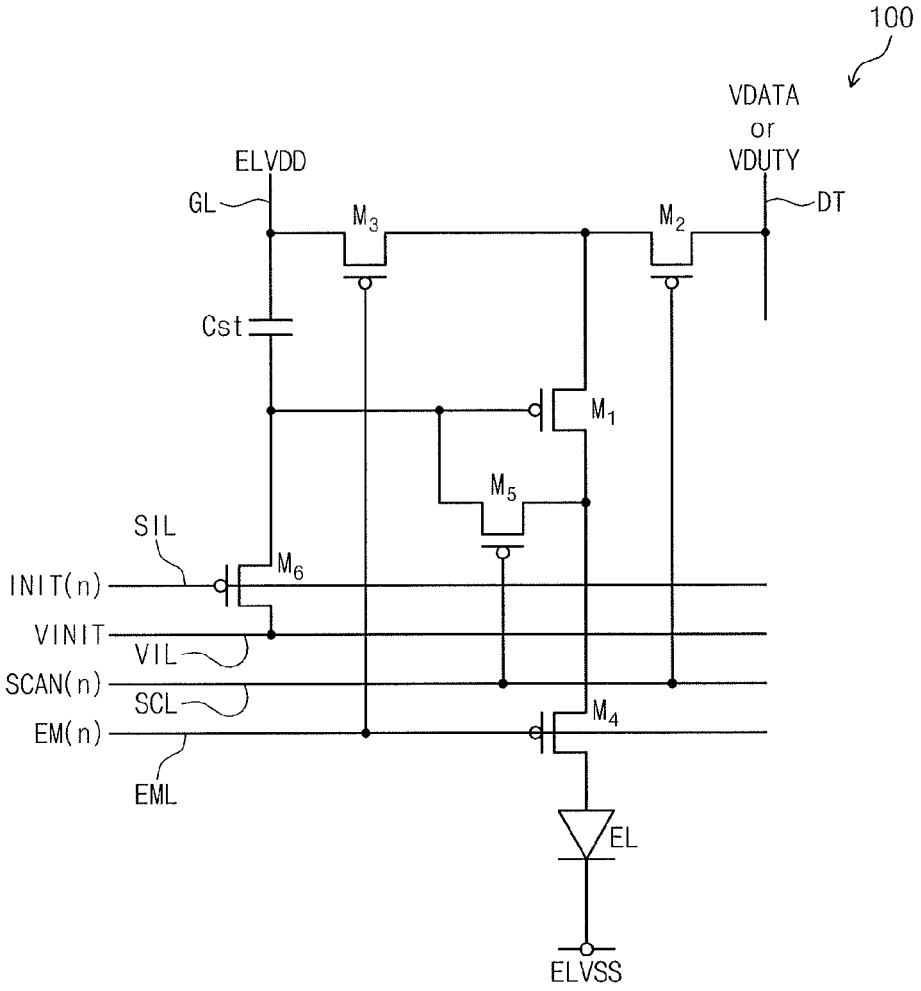
FIG. 2 illustrates an embodiment of a pixel circuit.

FIG. 2 illustrates an embodiment of a pixel circuit, which, for example, may correspond to the pixel circuits 100 in the EL display device of FIG. 1. Referring to FIG. 2, the pixel circuit 100 includes a driving transistor $M_1$, a sampling switch $M_2$, switch transistors $M_3$, $M_4$, $M_5$, and $M_6$, a capacitive element Cst, and an EL element. In this embodiment, each transistor is a p-type thin film transistor.

The driving transistor $M_1$ supplies current to the EL element according to the potential of a gate terminal of the driving transistor $M_1$. The sampling transistor $M_2$ samples a data voltage corresponding to image data at the gate terminal of the driving transistor $M_1$. The switch transistor $M_5$ is used to place the driving transistor $M_1$ in a diode-connected state. The capacitive element Cst holds the potential of the gate terminal of the driving transistor $M_1$. The EL element emits light according to the supplied current.

One terminal of the switch transistor $M_6$ is connected to an initialization voltage line VIL. Another terminal of the switch transistor $M_6$ is connected to the gate terminal of the driving transistor $M_1$ and the capacitive element Cst. The switch transistor $M_6$ is controlled by an initialization control signal INIT, which is provided to the gate terminal of the switch transistor $M_6$.

The switch transistor $M_6$, that is controlled by the initialization control signal INIT, initializes the gate terminal of the driving transistor $M_1$ and a potential of the capacitive element Cst with an initialization voltage VINIT.

One terminal of the switch transistor $M_2$ is connected to a signal line DT supplied with a data voltage VDATA or a duty control voltage VDUTY, and the other terminal thereof is connected to a source terminal of the driving transistor $M_1$. One terminal of the switch transistor $M_3$ is connected to the power line GL supplied with a power supply voltage ELVDD, and the other terminal thereof is connected to the source terminal of the driving transistor $M_1$.

A gate terminal of the switch transistor $M_2$ is connected to the scan line SCL. The switch transistor $M_2$ is controlled by a scan signal SCAN supplied to the gate terminal of the switch transistor $M_2$ via the scan line SCL. The gate terminal of the switch transistor $M_3$ is connected to the light-emitting control line EML. The switch transistor $M_3$ is controlled by the light-emitting control signal EM, which is provided to the gate terminal of the switch transistor $M_3$ via a light-emitting control line EML.

The switch transistor $M_2$ provides the source terminal of the driving transistor $M_1$ with one of the data voltage VDATA or the duty control voltage VDUTY. The power supply voltage ELVDD is provided to the source terminal of the driving transistor $M_1$ via the switch transistor $M_3$.

The gate terminal of the switch transistor $M_5$ is connected to the scan line SCL. The switch transistor $M_5$ is controlled by a scan signal SCAN, which is provided to the gate terminal of the switch transistor $M_5$ via the scan line SCL.

One terminal of the switch transistor $M_4$ is connected to the drain terminal of the driving transistor $M_1$, and another terminal thereof is connected to the EL element. A gate terminal of the switch transistor $M_4$ is connected to the light-emitting control line EML. The switch transistor $M_4$ is controlled by the light-emitting control signal EM, which is provided to the gate terminal of the switch transistor $M_4$ via the light-emitting control line EML.

Figure 3:
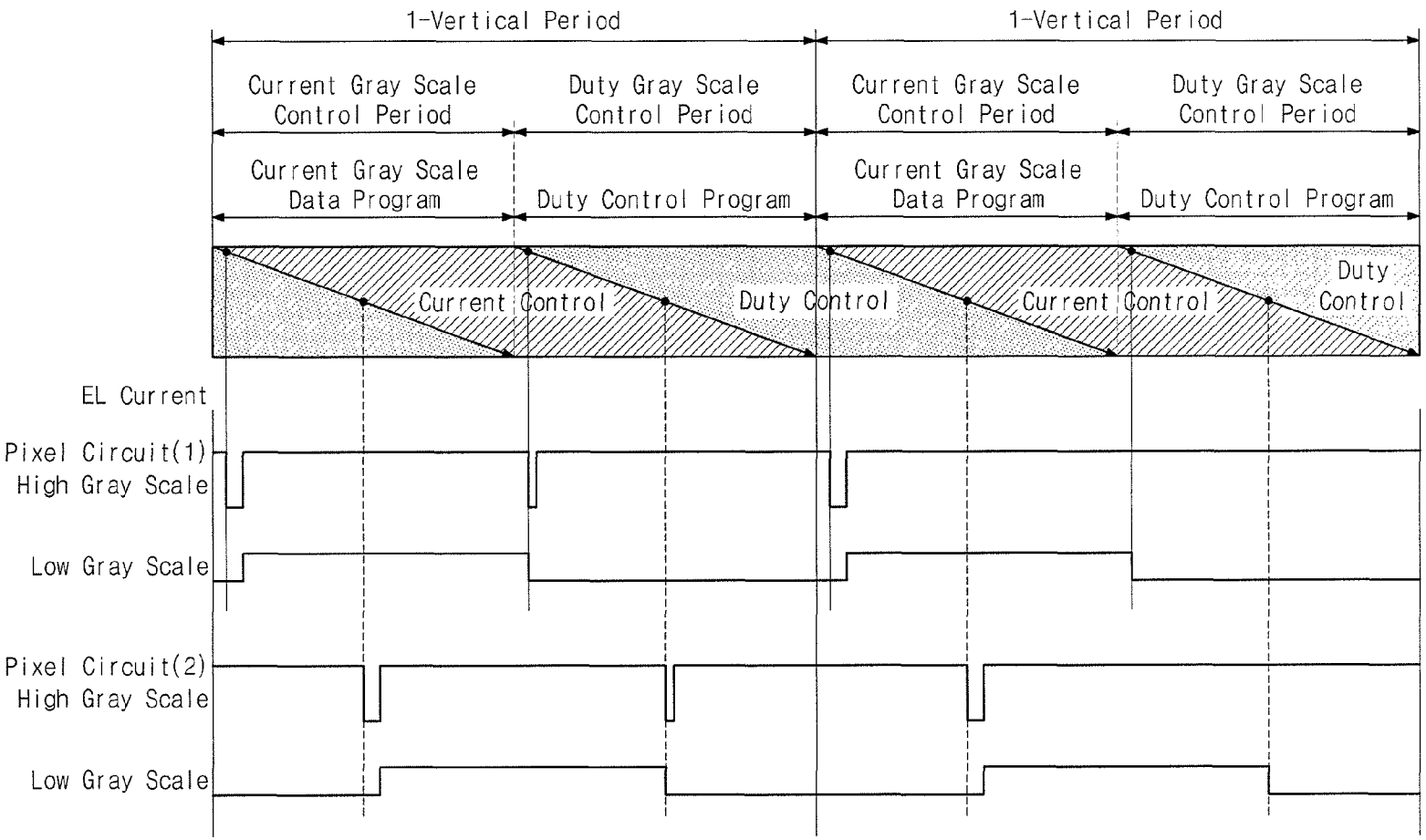
FIG. 3 illustrates an example of how the EL display device operates.

FIG. 3 is an example of a timing diagram illustrating operation of the EL display device 500. In FIG. 3, one vertical period includes a current gray scale control period and a duty gray scale control period. In the current gray scale control period, data voltages VDATA corresponding to image data are programmed at the pixel circuits 100 line-sequentially, to thereby control the current to be supplied to EL elements.

The duty control voltage VDUTY is used to stop the pixel circuits 100 from emitting light or to continue to emit light, e.g., maintain a sampled data voltage according to a current gray scale control way. In the duty gray scale control period, a period in which current is supplied to the EL element is adjusted. For example, in the duty gray scale control period, light-emission from the pixel circuits 100 is interrupted at one or more low gray scale values and is made at one or more high gray scales. In one embodiment, the EL display device 500 uses current gray scale control and duty gray scale control to control gray scale values of the pixel circuits 100.

Figure 4:
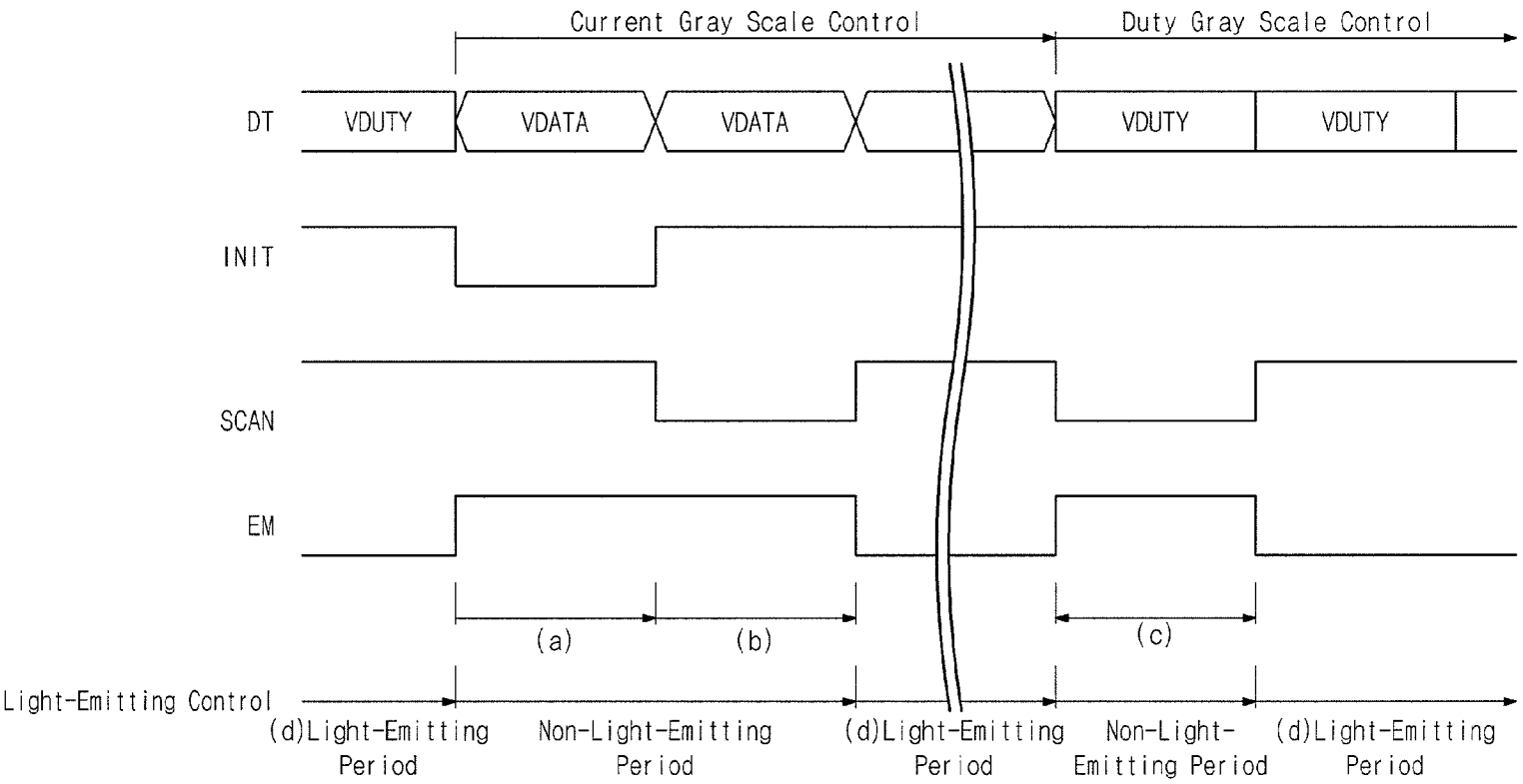
FIG. 4 illustrates an example of control signals for the EL display device.
Figure 5:
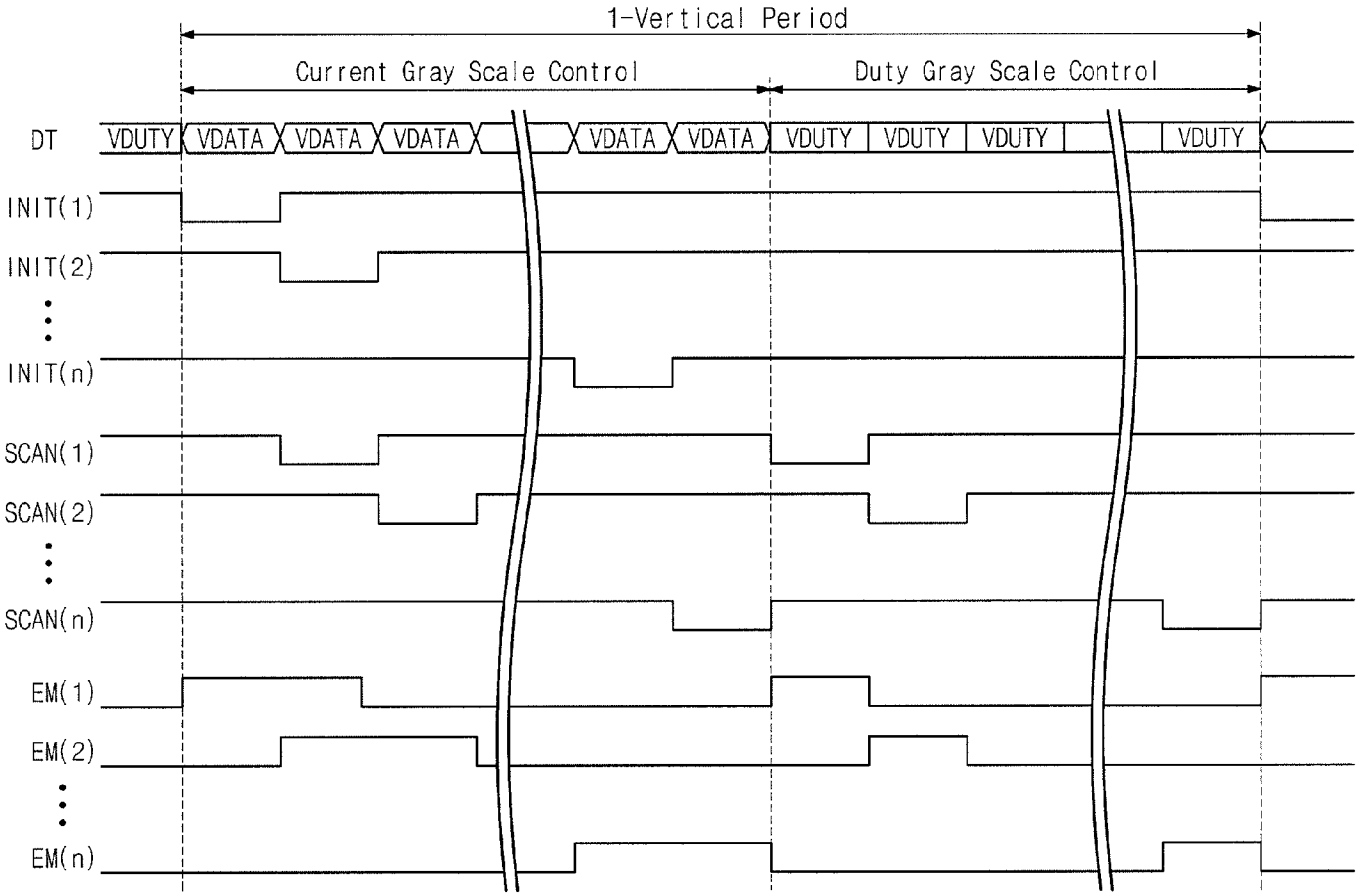
FIG. 5 illustrates an example of more control signals for the EL display device.

FIG. 4 is an example of another timing diagram for controlling operation of a unit pixel circuit. FIG. 5 is an example of another timing diagram for controlling operation of pixel circuits in rows. The pixel circuit(s) may be pixel circuits 100.

Referring to FIGS. 4 and 5, a method for driving the EL display device 500 is performed based on an initialization period (a), a threshold voltage (VTH) correction and data programming period (b), a duty control period (c), and a light-emitting period (d).

In each period, the pixel circuits 100 may be line-sequentially controlled by control signals INIT, SCAN, and EM. Current gray scale control and duty gray scale control based on image data are performed with respect to each pixel circuit 100, using a data voltage VDATA and a duty control voltage VDUTY that are provided to a source terminal of a driving transistor $M_1$ via a signal line DT.

Also, the gray scale value of light emitted from each pixel circuit 100, if controlled, may depend on a sum of current provided to an EL element in the current gray scale control period and current provided to the EL element in the duty gray scale control period. The current gray scale control period and the duty gray scale control period may be set to the same time, to thereby simplifying gray scale control. In other embodiments, these periods may be set to different times. The above-described control periods will be more fully described with reference to FIGS. 6A-6D.

FIGS. 6A to 6D illustrate different operating states of a pixel circuit, e.g., pixel circuit 100.

Initialization Period

Figure 6A:
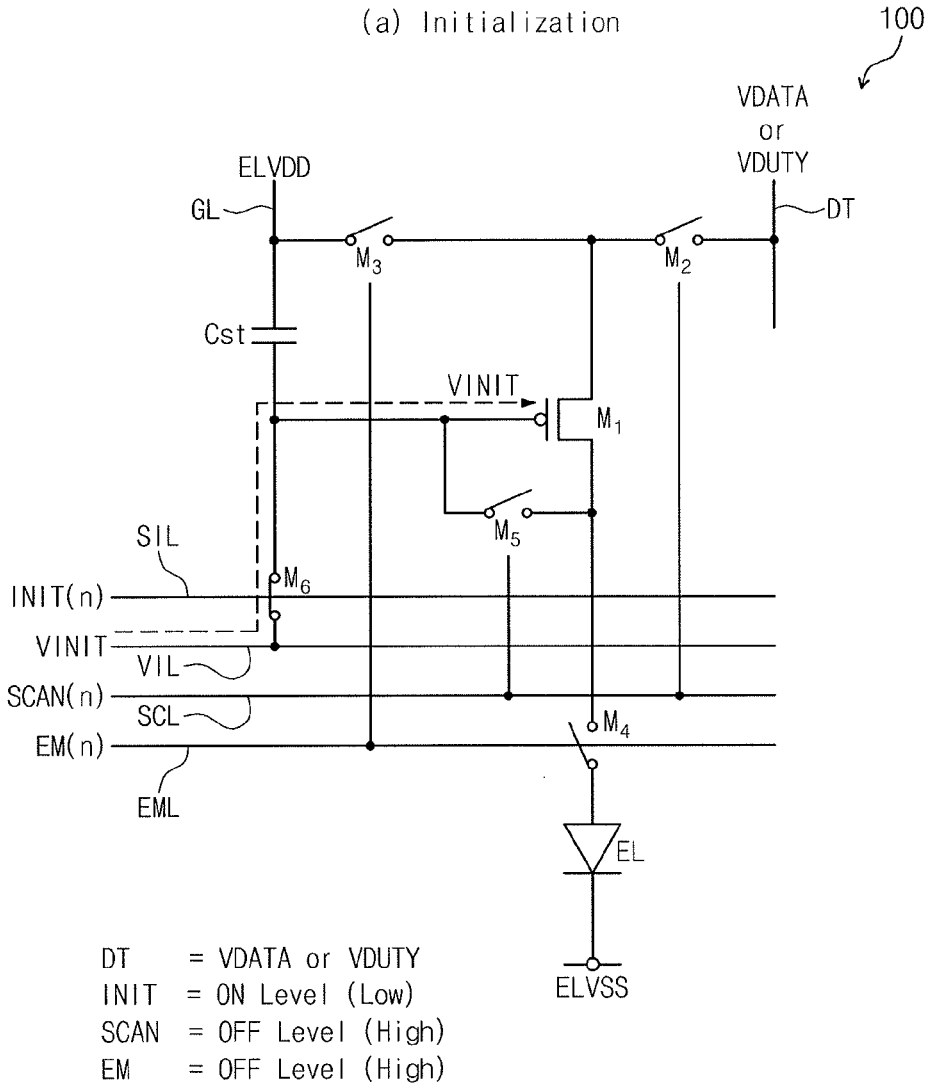
FIGS. 6A-6D illustrate different operating states of the pixel circuit.

Referring to FIG. 6A, during the initialization period (a), the switch transistor $M_6$ is turned on by the initialization control signal INIT. The initialization voltage VINIT is provided to the gate terminal of the driving transistor $M_1$ and the capacitive element Cst through the switch transistor $M_6$. Thus, the gate terminal of the driving transistor $M_1$ and the potential of the capacitive element Cst are initialized based on the initialization voltage VINIT.

VTH Correction and Data Programming Period

Figure 6B:
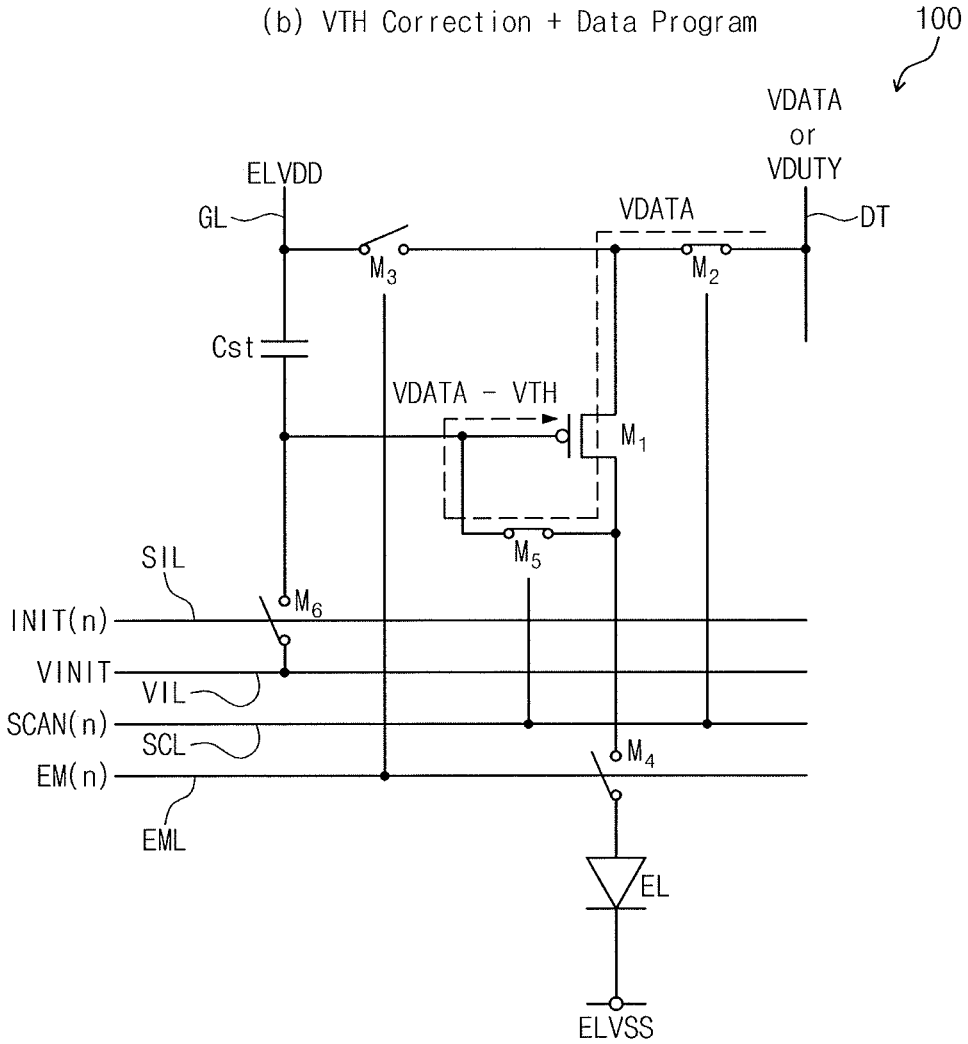

Referring to FIG. 6B, during the VTH correction and data programming period (b), the switch transistor $M_6$ is turned off and the switch transistors $M_2$ and $M_5$ are turned on by a scan signal SCAN. The data line DT receives the data voltage VDATA, and the driving transistor $M_1$ is diode-connected through the switch transistor $M_5$.

The data voltage VDATA corresponding to image data is provided to the source terminal of the driving transistor $M_1$. At this time, the capacitive element Cst samples a voltage of (VDATA−VTH), where VTH is the threshold voltage of the driving transistor $M_1$.

Duty Control Period

Figure 6C:
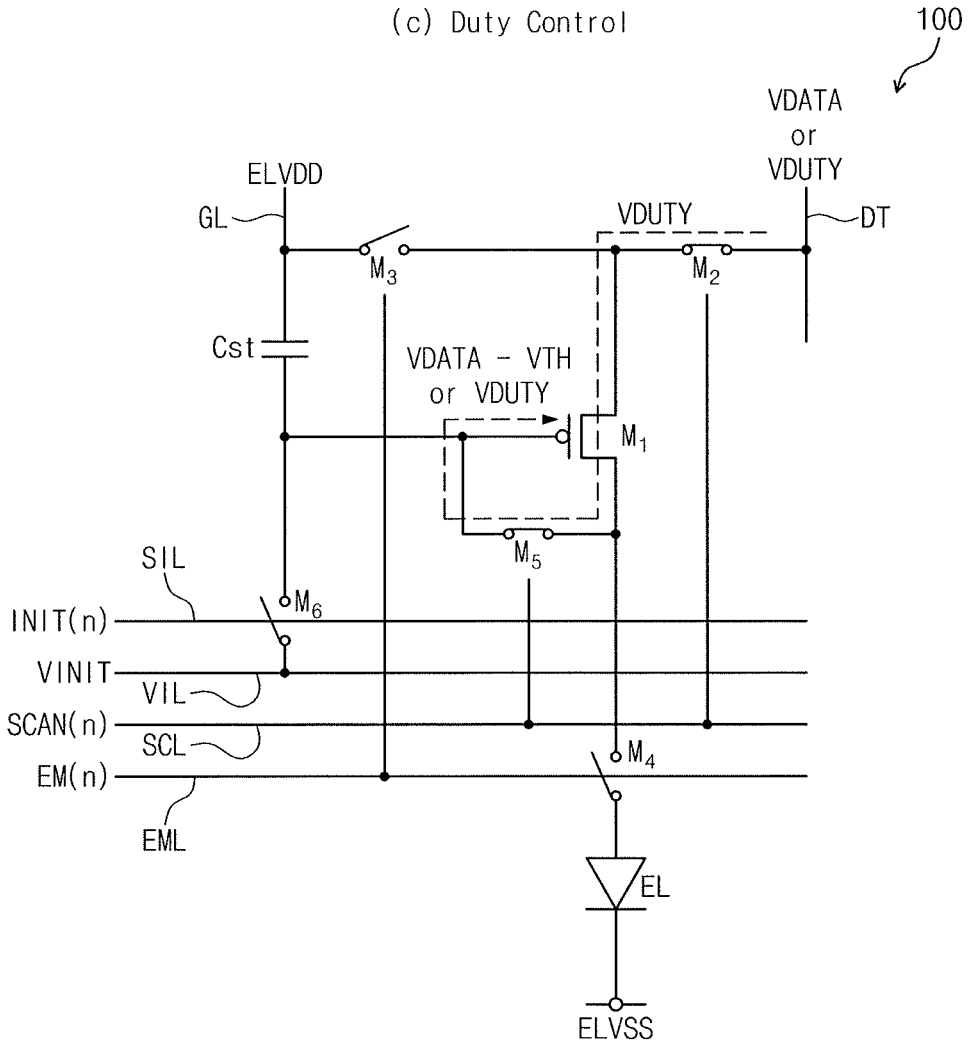

Referring to FIG. 6C, during the duty control period (c), the signal line DT receives the duty control voltage VDUTY. The duty control voltage VDUTY has two voltage values. The two voltage values of the duty control voltage VDUTY are provided to the source terminal of the driving transistor $M_1$ according to display gray scale, such that light-emitting halt (high level) and light-emitting continuance (low level) of the pixel circuit 100 are performed.

Light-Emitting Period

Figure 6D:
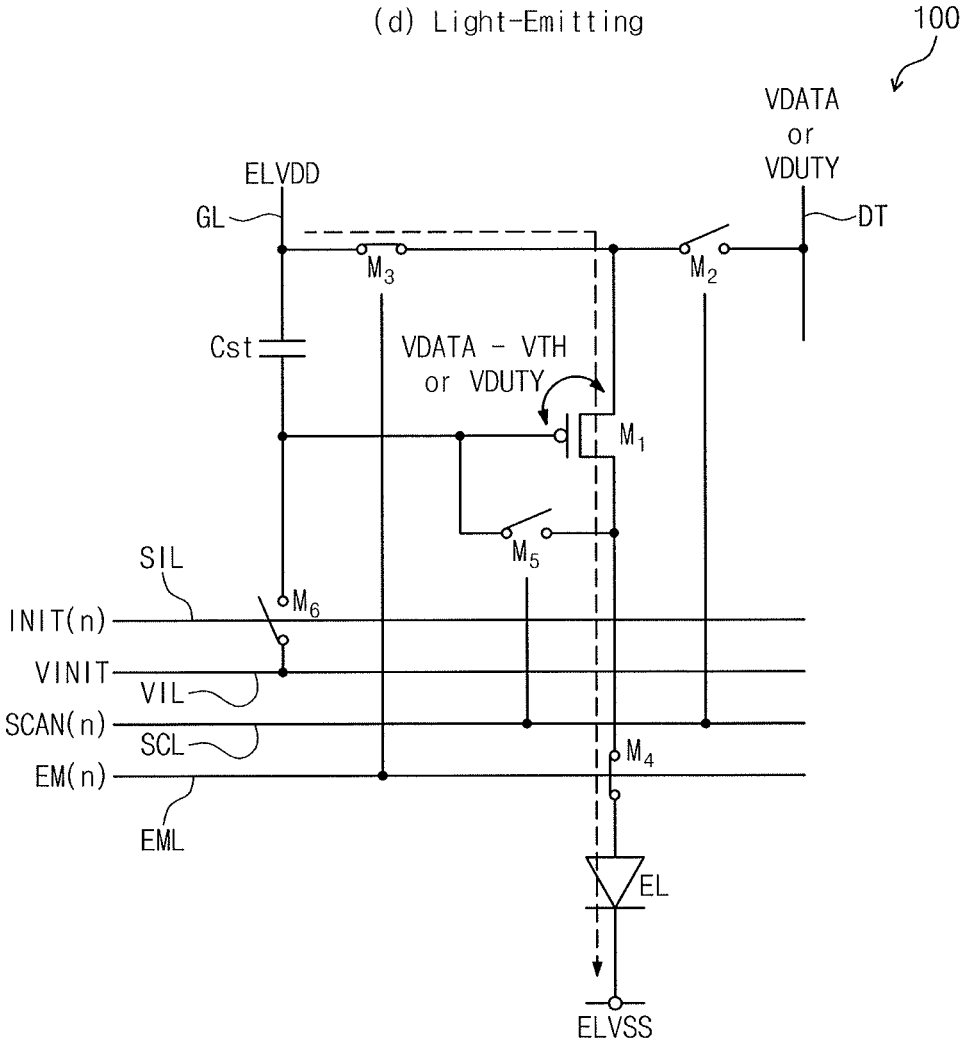

Referring to FIG. 6D, during the light-emitting period (d), the switch transistors $M_2$ and $M_5$ are turned off by the scan signal SCAN, and the switch transistors $M_3$ and $M_4$ are turned on by the light-emitting control signal EM. Current controlled by the driving transistor $M_1$ is provided to the EL element. That is, light-emitting of the pixel circuit 100 is controlled.

Figure 7:
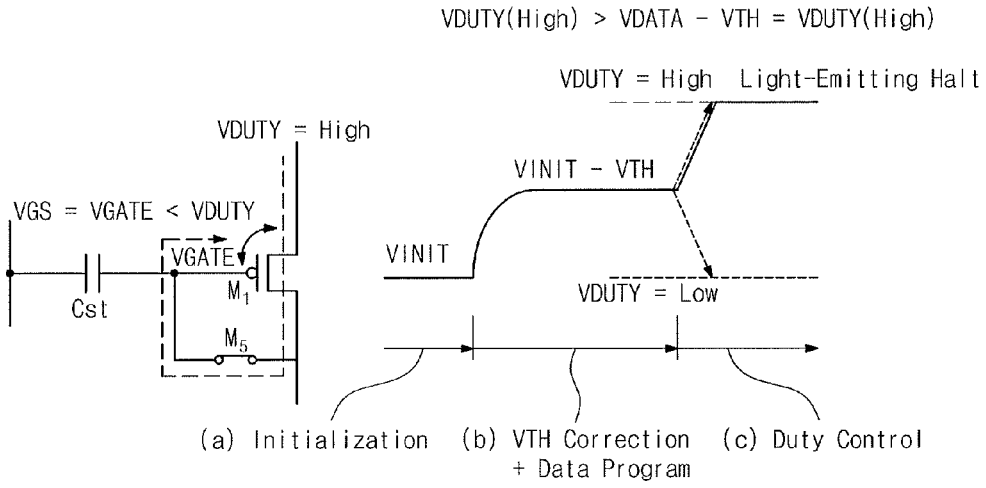
FIG. 7 illustrates an example of a duty control program.
Figure 8:
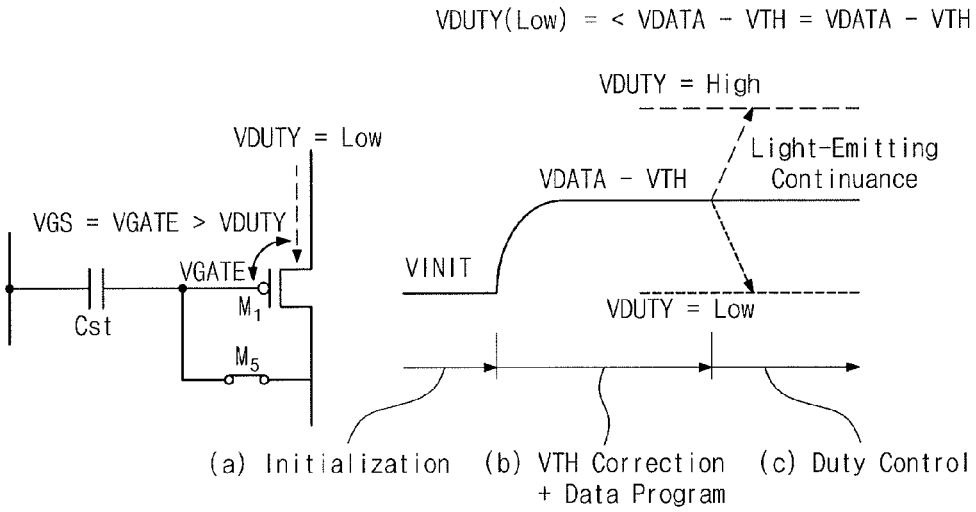
FIG. 8 illustrates an example of another duty control program.

FIG. 7 illustrates an example of a duty control program 1, and FIG. 8 illustrates an example of a duty control program 2. When VTH correction on a diode-connected driving transistor $M_1$ is performed, the driving transistor $M_1$ may be programmed in one direction corresponding to a charging direction (or, a discharging direction) due to its diode characteristic. That is, when VTH correction on the diode-connected driving transistor $M_1$ is performed, the driving transistor $M_1$ is turned off but cannot be turned on when a voltage is supplied to a source terminal of the driving transistor $M_1$.

Two voltage values of a duty control voltage VDUTY may be set to be higher than the lowest gray scale voltage (e.g., dark) and to be lower than the highest gray scale voltage (e.g., bright). Thus, a light-emitting halt operation and a light-emitting continuance operation (e.g., maintain a sampled data voltage according to current gray scale control) are performing using the two voltage values.

Referring to FIG. 7, the source terminal of a driving transistor $M_1$, where a voltage of (VDATA−VTH) is sampled after initialization, is supplied with a duty control voltage VDUTY (high level) greater than (VDATA−VTH). In this case, the driving transistor $M_1$ is turned off because the gate voltage of the driving transistor $M_1$ is overwritten with the duty control voltage VDUTY at the high level. As a result, the supply of current to the EL element is stopped during the light-emitting period, and the EL element does not emit light even though the switch transistor $M_4$ is turned on.

Referring to FIG. 8, the source terminal of the driving transistor $M_1$, where a voltage of (VDATA−VTH) is sampled after initialization, is supplied with a duty control voltage VDUTY (low level) lower than (VDATA−VTH). In this case, the gate voltage of the driving transistor $M_1$ is (VDATA−VTH), because it is not overwritten with the duty control voltage VDUTY at the low level. Thus, during the light-emitting period, current is supplied to the EL element when the switch transistor $M_4$ is turned on, which maintains light-emitting of the EL element.

Figure 9:
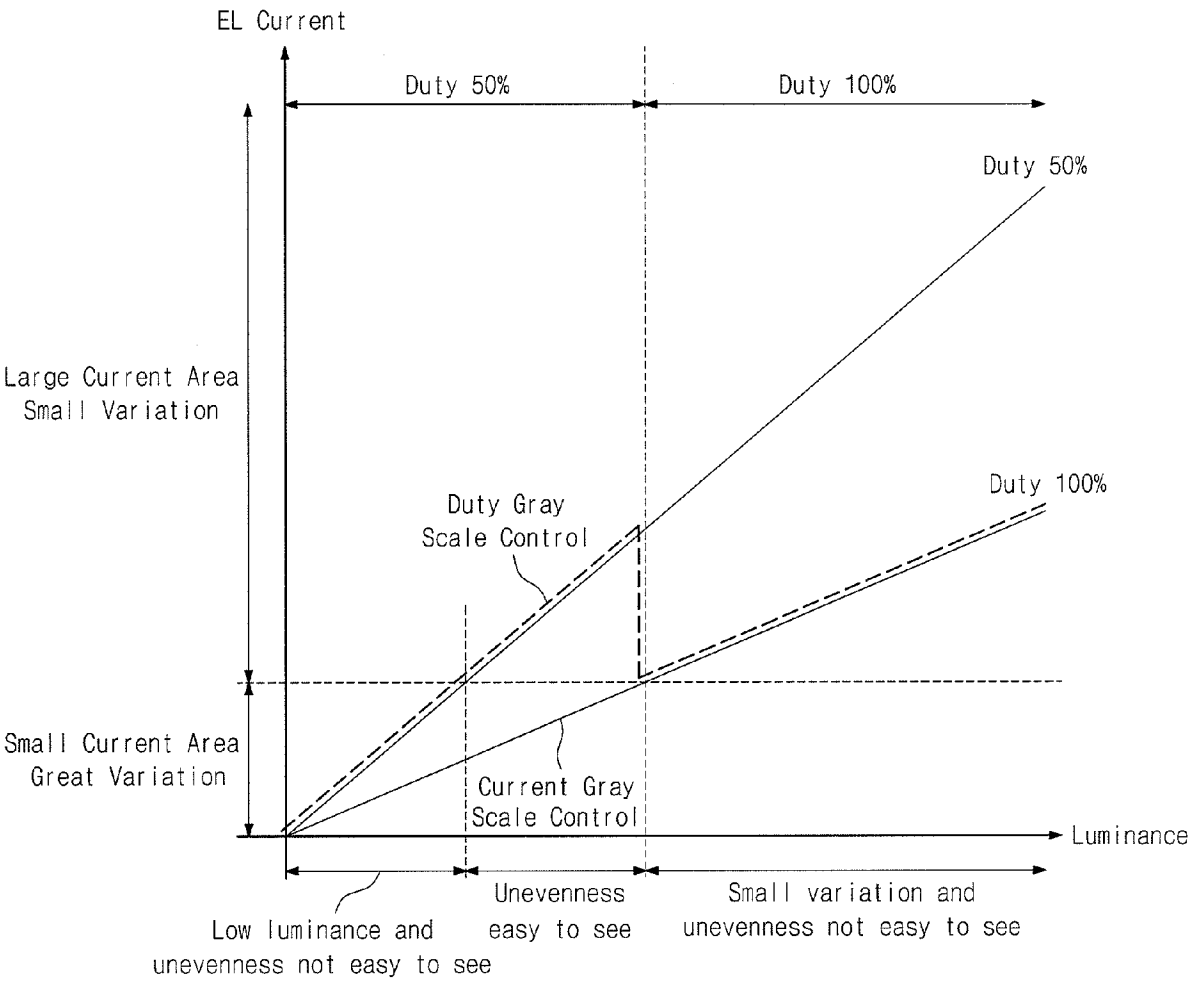
FIG. 9 illustrates an example of EL current and luminance.
Figure 10:
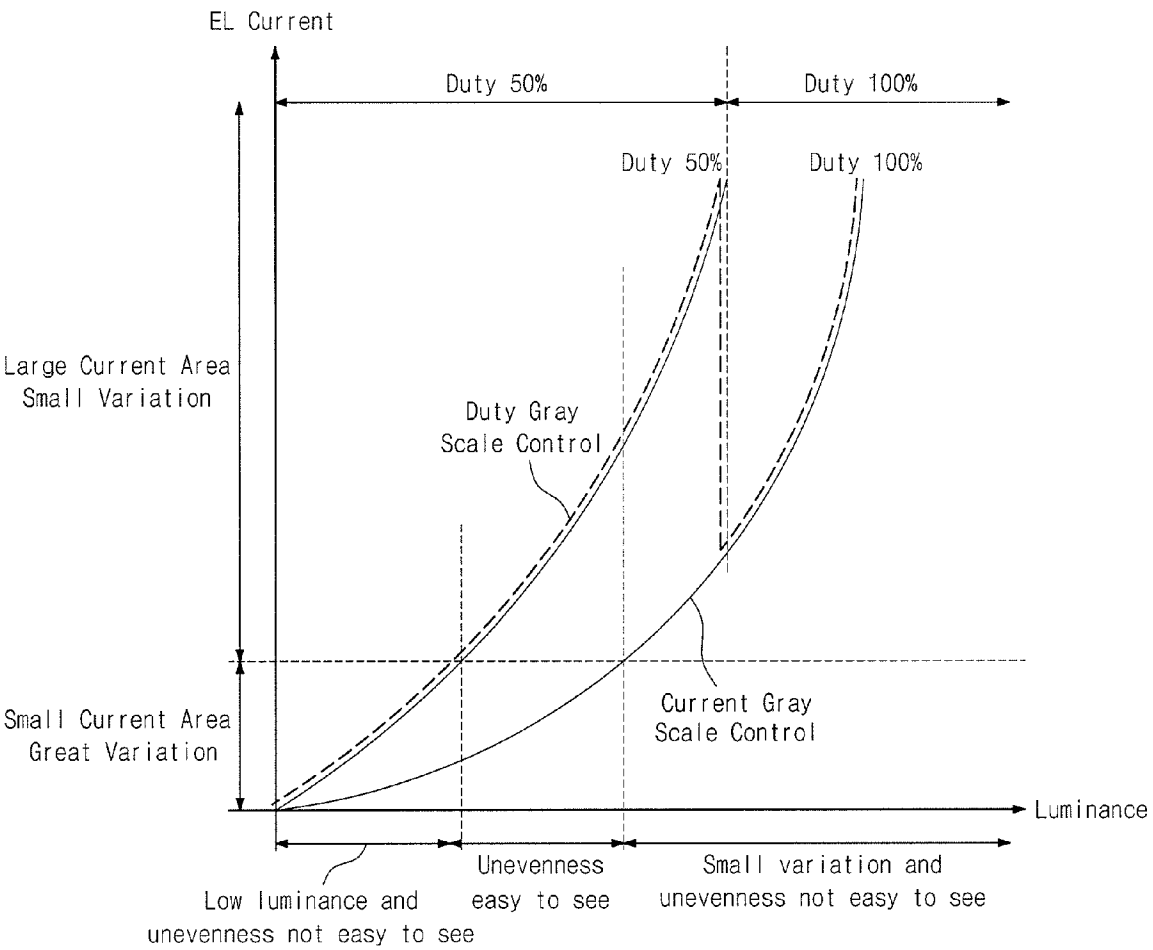
FIG. 10 illustrates an example of EL current and gray scale.

FIG. 9 illustrates an example of a relationship between EL current and luminance, and FIG. 10 illustrates an example of a relationship between EL current and gray scale. In FIG. 10, the relationship between the EL current and the gray scale corresponds to a gamma curve.

Referring to FIG. 9, the light-emitting duty period (e.g., a period where current flows into the EL element) varies with gray scale value. For example, the light-emitting duty period at a high gray scale value (e.g., bright) is longer than the light-emitting duty period at a low gray scale value (e.g., dark).

At a low gray scale value, the current flowing into the EL element decreases. This causes a deterioration in image quality due to variation in the threshold voltage VTH, thereby resulting in non-uniform luminance. In one embodiment, when the pixel circuit 100 is driven at a low gray scale value, the light-emitting duty period is controlled to decrease and current to be provided to the EL element is controlled to increase. Thus, it is possible to suppress deterioration of image quality due to threshold voltage VTH variation.

Meanwhile, at high gray scale values, the luminance of the EL element deteriorates when a maximum current is provided to the EL element increases. In one embodiment, when the pixel circuit 100 is driven at a high gray scale value, the light-emitting duty period is controlled to increase and the maximum current provided to the EL element is controlled to be suppressed, e.g., reduce. Thus, it is possible to make the useful life time of the EL element longer.

Referring to FIG. 10, as indicated above, when the pixel circuit 100 is driven at a high gray scale value, it is desirable to suppress (reduce) the maximum current to be supplied to the EL element. However, when the pixel circuit 100 is driven at a low gray scale value, it is desirable to increase the intensity of current in order to suppress variation in the threshold voltage VTH. This operation may be performed through duty control.

With the above description, it is possible to suppress deterioration of image quality (e.g., non-uniformity) at low gray scale values, even though the current to be provided to the EL element of a unit pixel decreases as an increase in resolution. Thus, high image quality and long life time may be achieved at high resolutions of the EL display device 500.

Figure 11:
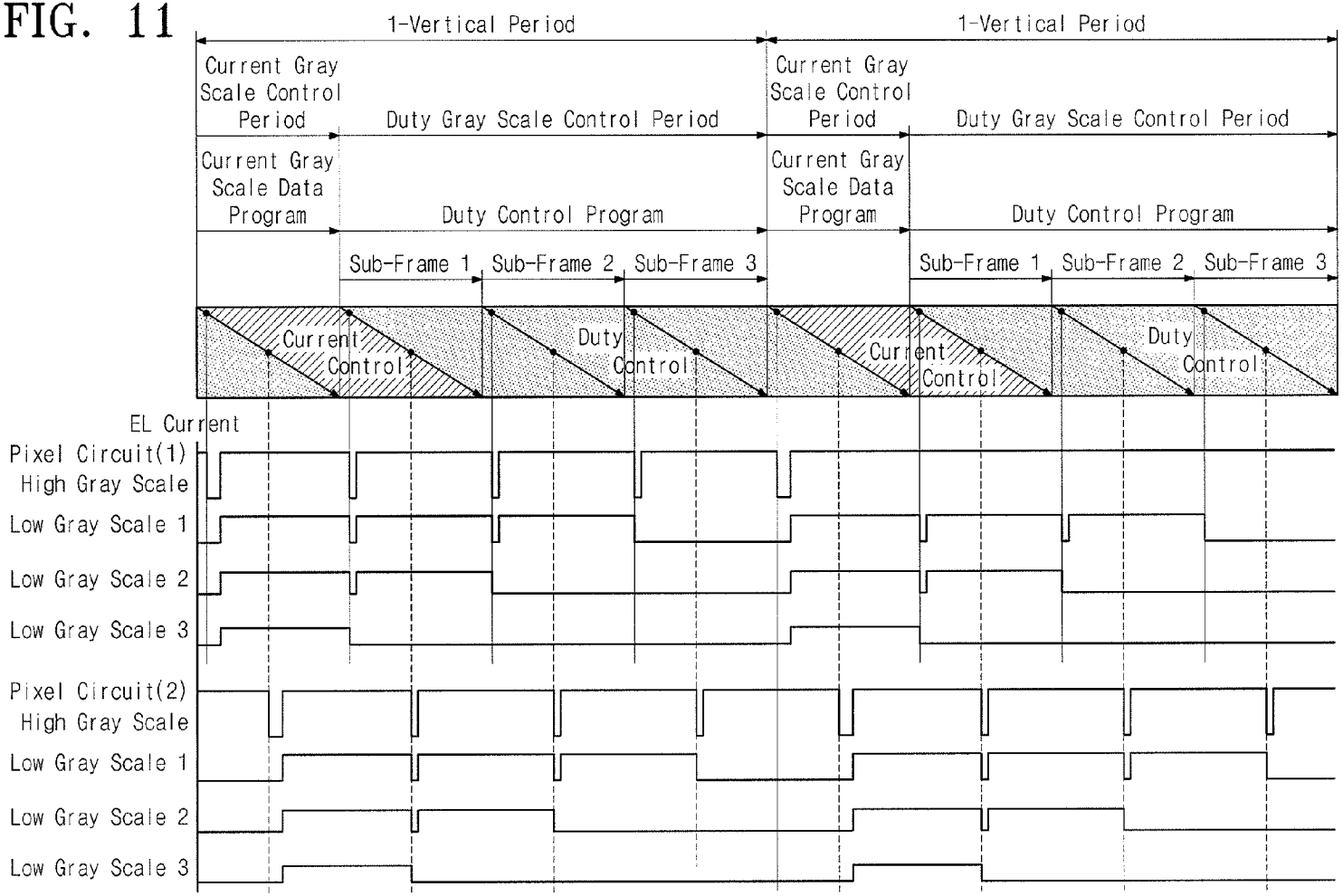
FIG. 11 illustrates another example of how an EL display device operates.
Figure 12:
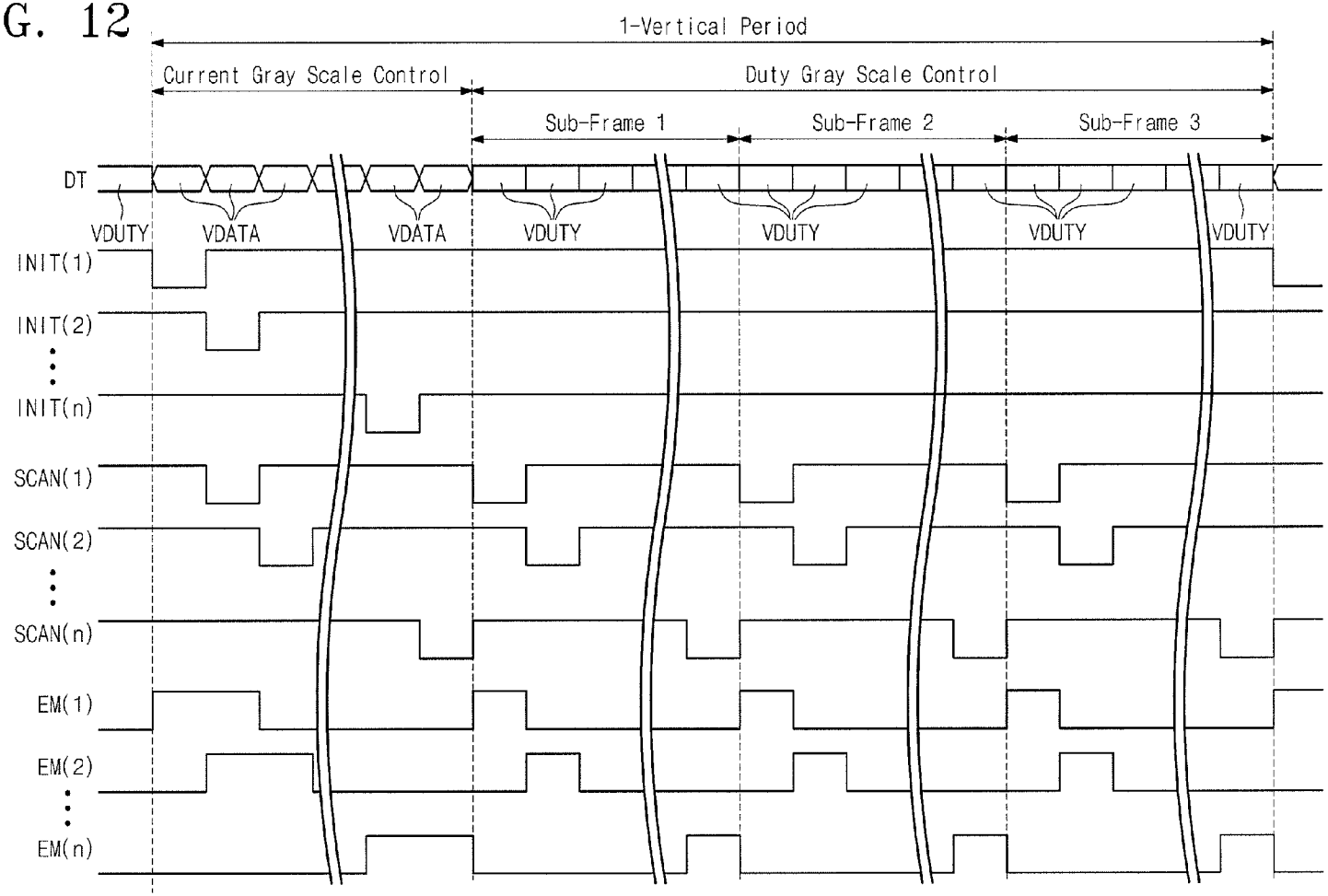
FIG. 12 illustrates an example of control signals for pixel circuits.

FIG. 11 another example of how an EL display device operates, and FIG. 12 is another example of a timing diagram for controlling operation of pixel circuits, e.g., pixel circuits 100. In this embodiment, the duty gray scale control period includes a plurality of sub-frames. A period where current is provided to the EL element according to a duty control voltage VDUTY is controlled on a sub-frame basis. Also, the current gray scale control period and a period of each sub-frame of the duty gray scale control period are set to be equal to each other.

Referring to FIGS. 11 and 12, like the previous embodiment, one vertical period includes a current gray scale control period and a duty gray scale control period. However, in this embodiment, the duty gray scale control period includes a plurality of sub-frames, and duty gray scale control is performed every sub-frame.

In the current gray scale control period, data voltages VDATA corresponding to image data are line-sequentially programmed at the pixel circuits 100, such that current to be provided to EL elements is controlled. In the duty gray scale control period having a plurality of sub-frames, a period where current is provided to the EL element is controlled by making the pixel circuits 100 stop emitting light or continue emitting light according to a duty control voltage VDUTY every sub-frame.

For example, in the duty gray scale control period, he light-emitting duty period is controlled to decrease when the pixel circuit 100 is driven at a low gray scale value. In one embodiment, if the pixel circuit 100 is controlled to stop emitting light, the pixel circuit 100 may not emit light until data is programmed again. When the pixel circuit 100 is controlled to stop emitting light, it is controlled to stop emitting light at the beginning of the duty gray scale control period.

Duty gray scale control is line-sequentially performed. Also, in this embodiment, the current gray scale control period is set to be the same as a period of each sub-frame of the duty gray scale control period, to thereby simplifying gray scale control. For illustrative purposes only, FIG. 11 illustrates a duty gray scale control period which includes three sub-frames. A different number of sub-frames (e.g., four or more) may be included in a duty gray scale control period in an alternative embodiment.

Figure 13:
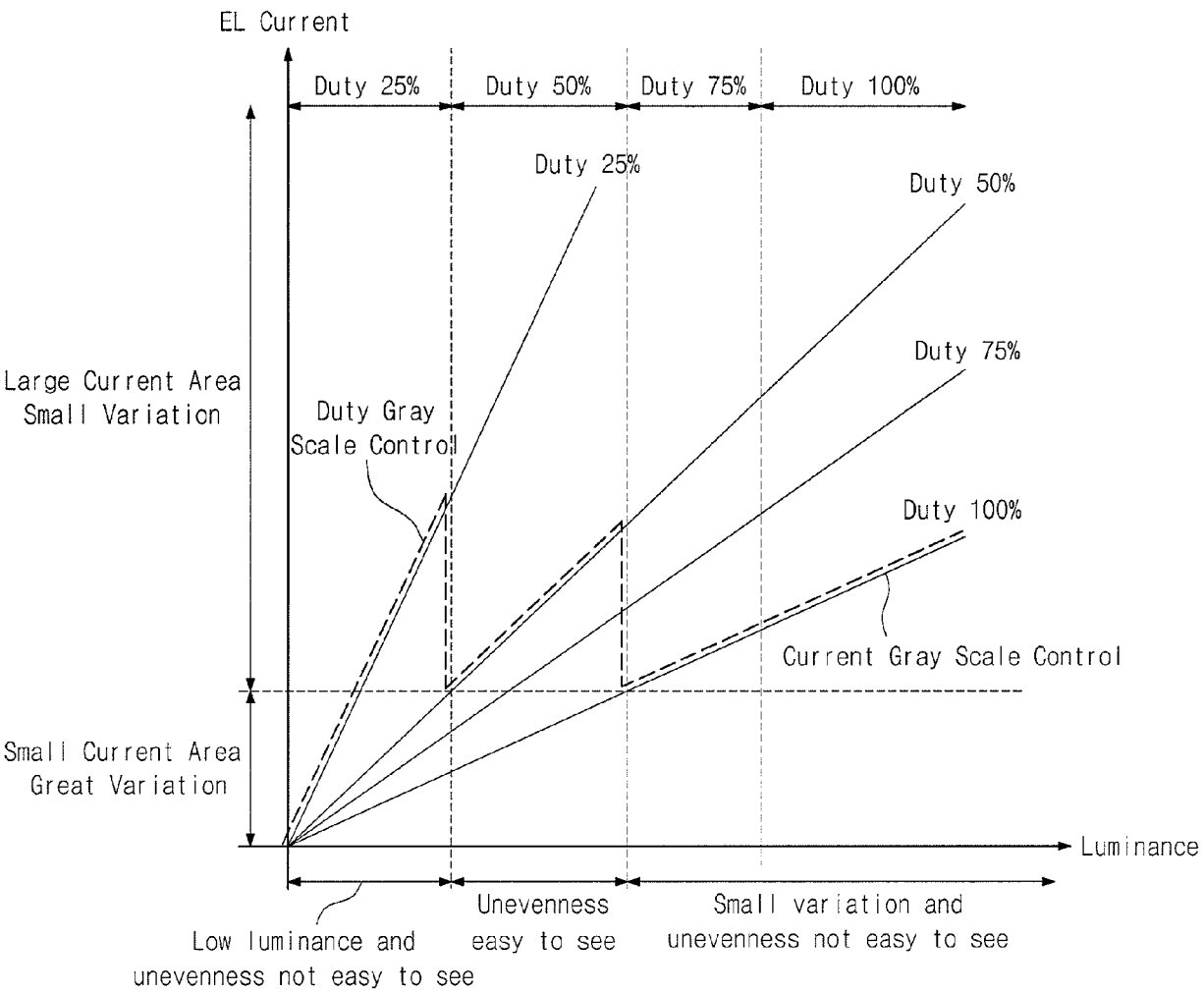
FIG. 13 illustrates another example of EL current and luminance.
Figure 14:
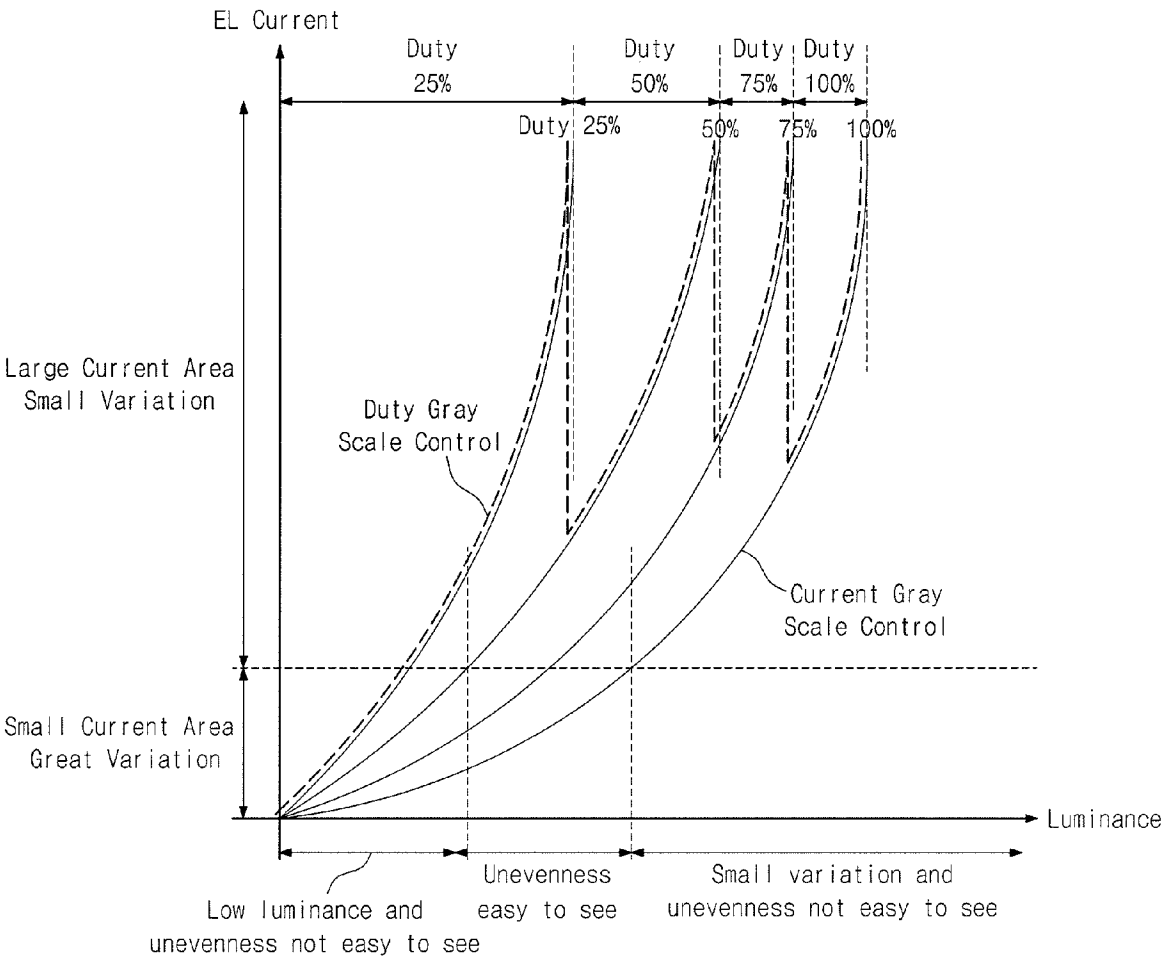
FIG. 14 illustrates another example of EL current and gray scale.

FIG. 13 illustrates an example of a relationship between EL current and luminance according to the present embodiment. FIG. 14 illustrates an example of a relationship between EL current and gray scale according to this embodiment. In FIG. 13, the relationship between the EL current and the gray scale corresponds to a gamma curve.

Referring to FIG. 13, duty control is performed using four values: 25%, 50%, 75%, and 100%. That is, the duty control is performed under the condition that a duty period is set to various values based on gray scale value. In this embodiment, a light-emitting duty period varies with gray scale value, e.g., the light-emitting duty period at low gray scale values is longer than that at high gray scale values.

At low gray scale values, a decrease in current flowing into the EL element causes a deterioration in image quality due to variation in threshold voltage VTH, thereby resulting in non-uniform luminance. In this embodiment, when the pixel circuit 100 is driven at low gray scale values, the light-emitting duty period is controlled to decrease and current to be provided to the EL element is controlled to increase. Thus, it is possible to suppress deterioration of image quality due to variation in threshold voltage VTH.

At high gray scale values, luminance of the EL element deteriorates when maximum current to be provided to the EL element increases. In this embodiment, when the pixel circuit 100 is driven at high gray scale values, the light-emitting duty period is controlled to increase and maximum current to be provided to the EL element is controlled to be suppressed, e.g., reduced. Thus, it is possible to make the useful life time of the EL element longer.

Referring to FIG. 14, as described above, when the pixel circuit 100 is driven at high gray scale values, maximum current to be supplied to the EL element may be suppressed. However, when the pixel circuit 100 is driven at low gray scale values, the intensity of current increases to suppress a variation in threshold voltage VTH. This operation may be performed through duty control. In this embodiment, because duty control is performed at various duty values, duty control is performed more finely compared to the previous embodiment.

Figure 15:
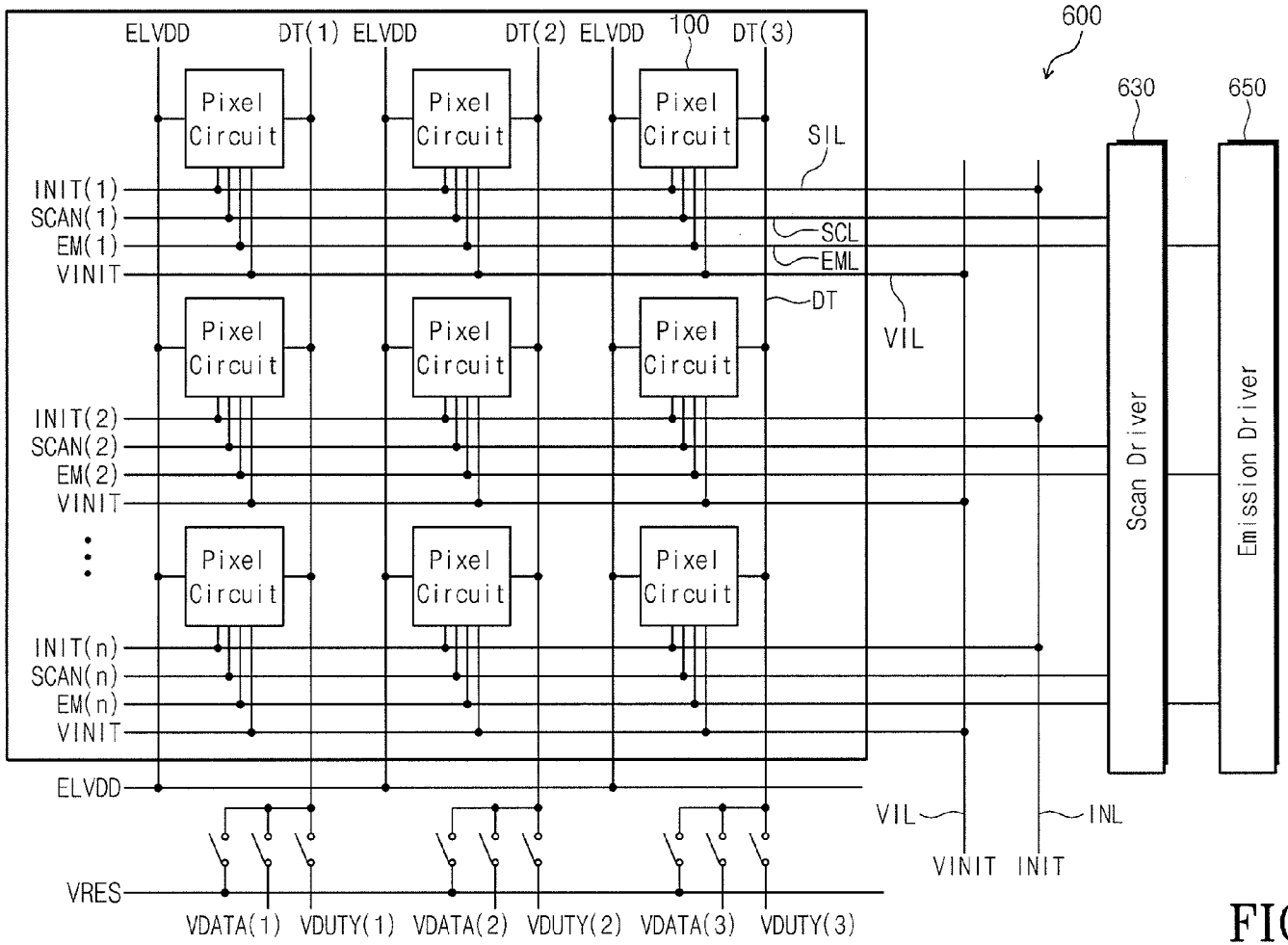
FIG. 15 illustrates another embodiment of an EL display device.

FIG. 15 illustrates another embodiment of an EL display device 600. In this third embodiment, initialization and VTH correction may be performed at the same time with respect to all pixel circuits. Data programming and duty control may be line-sequentially performed with respect to pixel circuits, and light-emitting timing and non-light-emitting timing are different every pixel.

Referring to FIG. 15, the EL display device 600 includes a plurality of pixel circuits 100 arranged in a matrix, a scan driver 630 to drive the pixel circuits 100, and an emission driver 650. Control lines SIL are connected to the pixel circuits 100. First ends of the control lines SIL are connected in common to receive an initialization control signal INIT. Thus, unlike the EL display device 500 in FIG. 1, the EL display device 600 in FIG. 15 does not include an initialization control driver.

Also, like the EL display device 500 in FIG. 1, the pixel circuits 100 are arranged in a matrix and are connected to scan lines SCL, light-emitting control lines EML, and initialization voltage lines VIL.

Also, like the EL display device 500 in FIG. 1, a scan driver 530 outputs scan signals SCAN through the scan lines SCL and an emission driver 550 outputs light-emitting control signals EM through the light-emitting control lines EML.

Also, unlike the EL display device 500 in FIG. 1, the EL display device 600 includes switches configured to provide data lines DL with a reference voltage VRES, as well as a data voltage VDATA and a duty control voltage VDUTY. The reference voltage VRES is used to correct a threshold voltage VTH.

Figure 16:
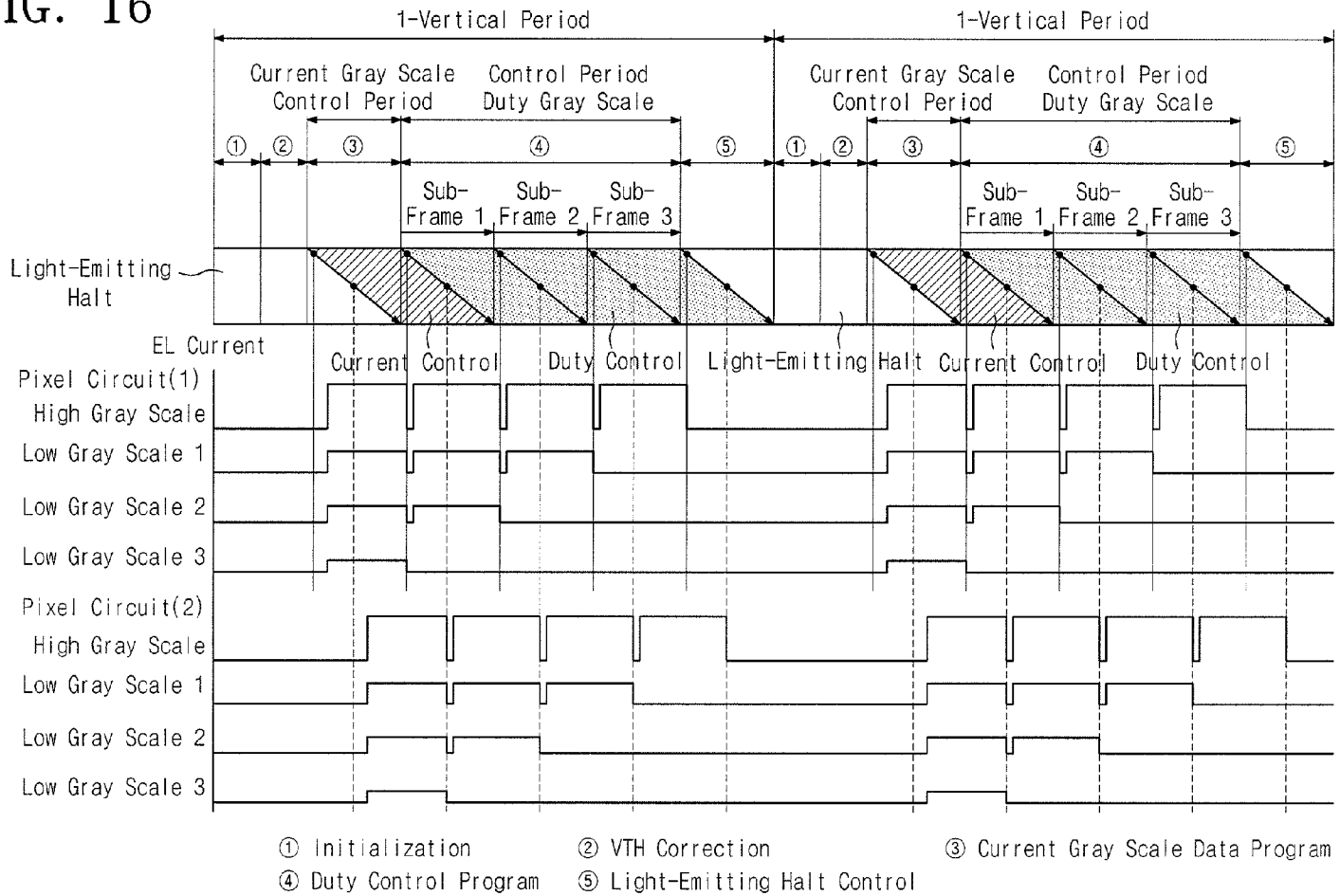
FIG. 16 illustrates another example of how an EL display device operates.

FIG. 16 illustrates an example of how the EL display device 600 operates. Referring to FIG. 16, in one horizontal period, initializing the gate terminal of a driving transistor $M_1$ and the potential of a capacitive element Cst, and correcting a threshold voltage of the driving transistor $M_1$, are simultaneously performed for all pixels. Programming data at the gate terminal of the driving transistor $M_1$, controlling the duty period of the driving transistor $M_1$, and stopping light emission of the EL element are line-sequentially performed for all pixel circuits.

Figure 17:
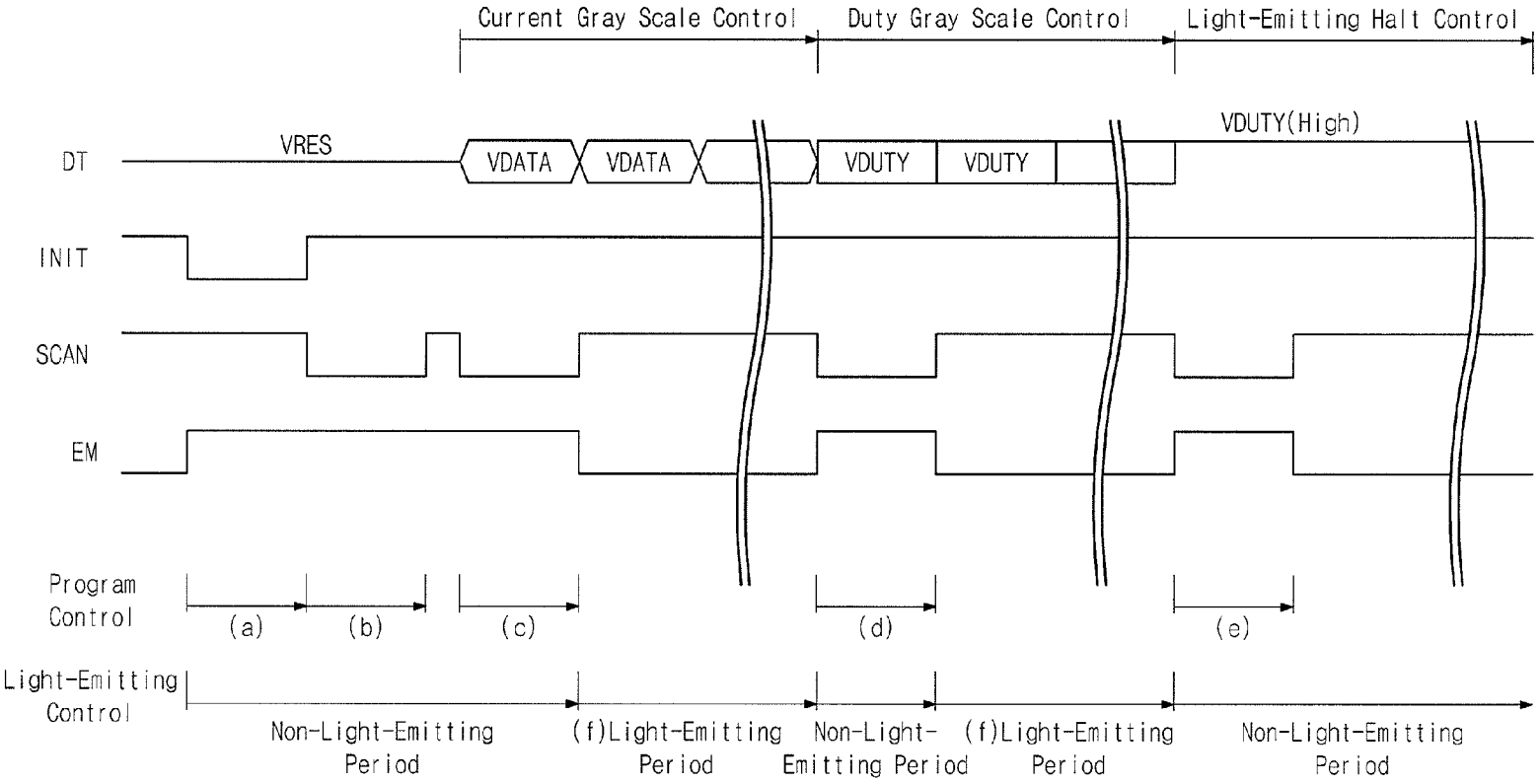
FIG. 17 illustrates another example of control signals for a pixel circuit.
Figure 18:
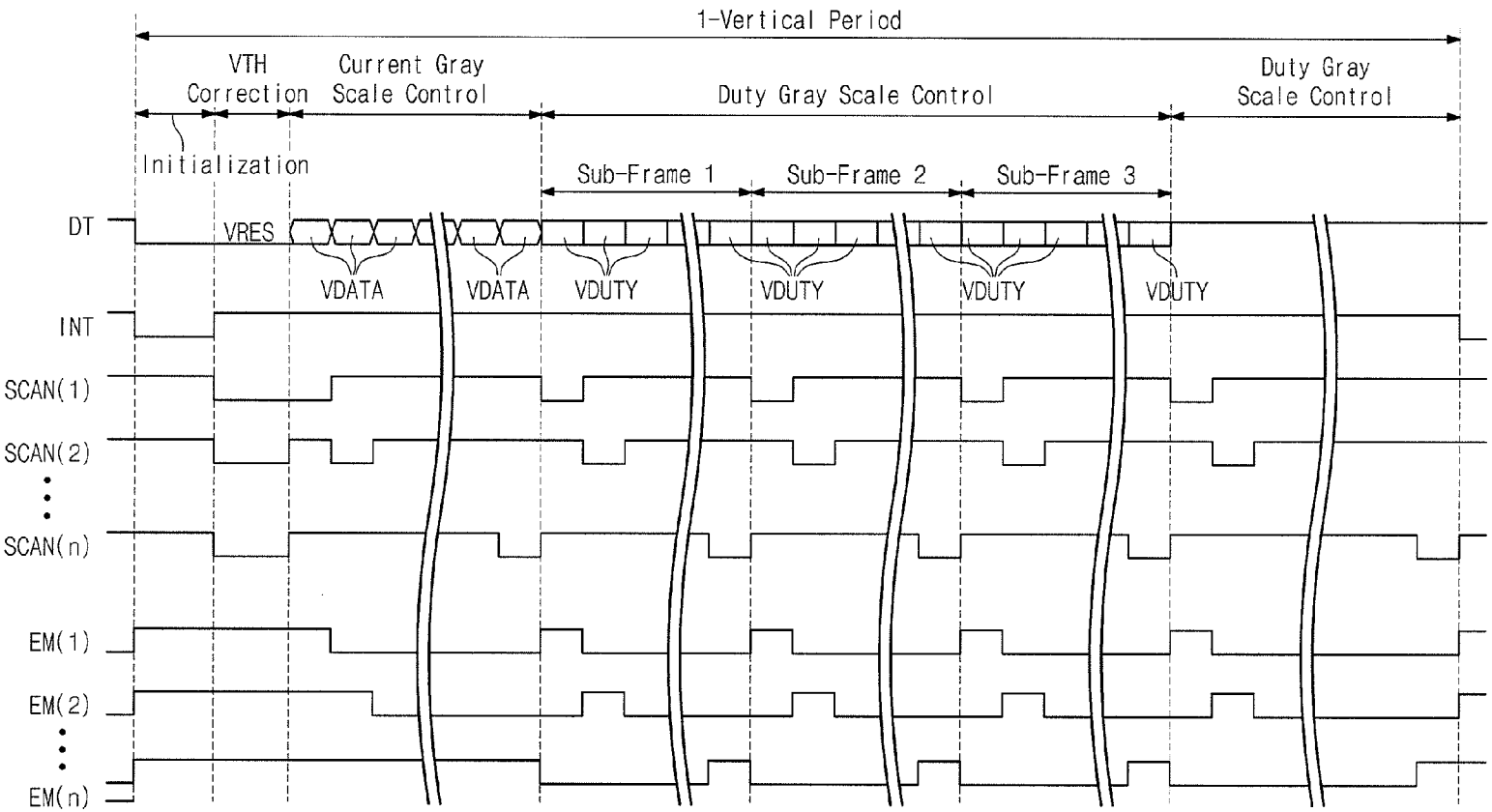
FIG. 18 illustrates another example of control signals for pixel circuits.

FIG. 17 illustrates another example of how a pixel circuit 100 operates. FIG. 18 is an example of a timing diagram illustrating operation of pixel circuits disposed in rows for this embodiment.

Referring to FIGS. 17 and 18, like the previous embodiment, one vertical period includes a current gray scale control period and a duty gray scale control period. Also, the duty gray scale control period includes a plurality of sub-frames. A period where current is provided to an EL element is controlled by a duty control voltage VDUTY every sub-frame. In the initialization and VTH correction periods, initializing the pixel circuits 100 and correcting a threshold voltage are simultaneously performed with respect to all pixels circuits 100.

A method for driving of an EL display device according to this embodiment includes an initialization period (a), a VTH correction period (b), a data programming period (c), a duty control period (d), a light-emitting halt control period (e), and a light-emitting period (f).

In this embodiment, initialization and VTH correction are simultaneously performed for all pixel circuits 100, and remaining operations are line-sequentially performed based on control signals SCAN and EM. Based on a data voltage VDATA and a duty control voltage VDUTY on a signal line DT provided to the source terminal of the driving transistor $M_1$, current gray scale control and duty gray scale control corresponding to image data are perform for every pixel circuit 100.

FIGS. 19A-19F illustrate different operating states of a pixel circuit for this embodiment for the four periods (a), (b), (c), and (d).

Initialization Period

Figure 19A:
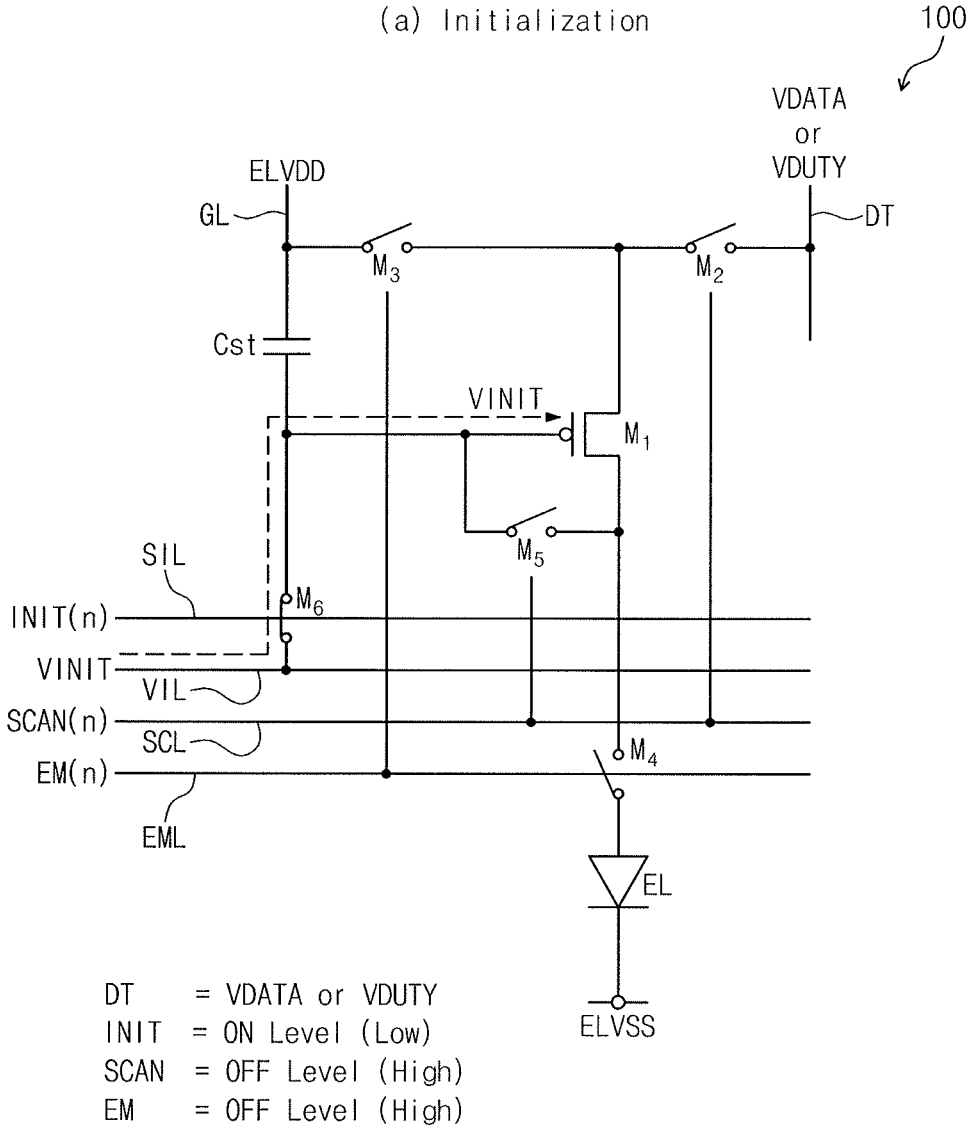
FIGS. 19A-19F illustrate different operating states of a pixel circuit.

Referring to FIG. 19A, during the initialization period (a), the switch transistor $M_6$ is turned on by an initialization control signal INIT supplied to the pixel circuit 100 via a common control line SIL. The initialization voltage VINIT is provided to the gate terminal of the driving transistor $M_1$ and the capacitive element Cst through the switch transistor $M_6$. Thus, the gate terminal of the driving transistor $M_1$ and the potential of the capacitive element Cst are initialized with the initialization voltage VINIT.

VTH Correction Period

Figure 19B:
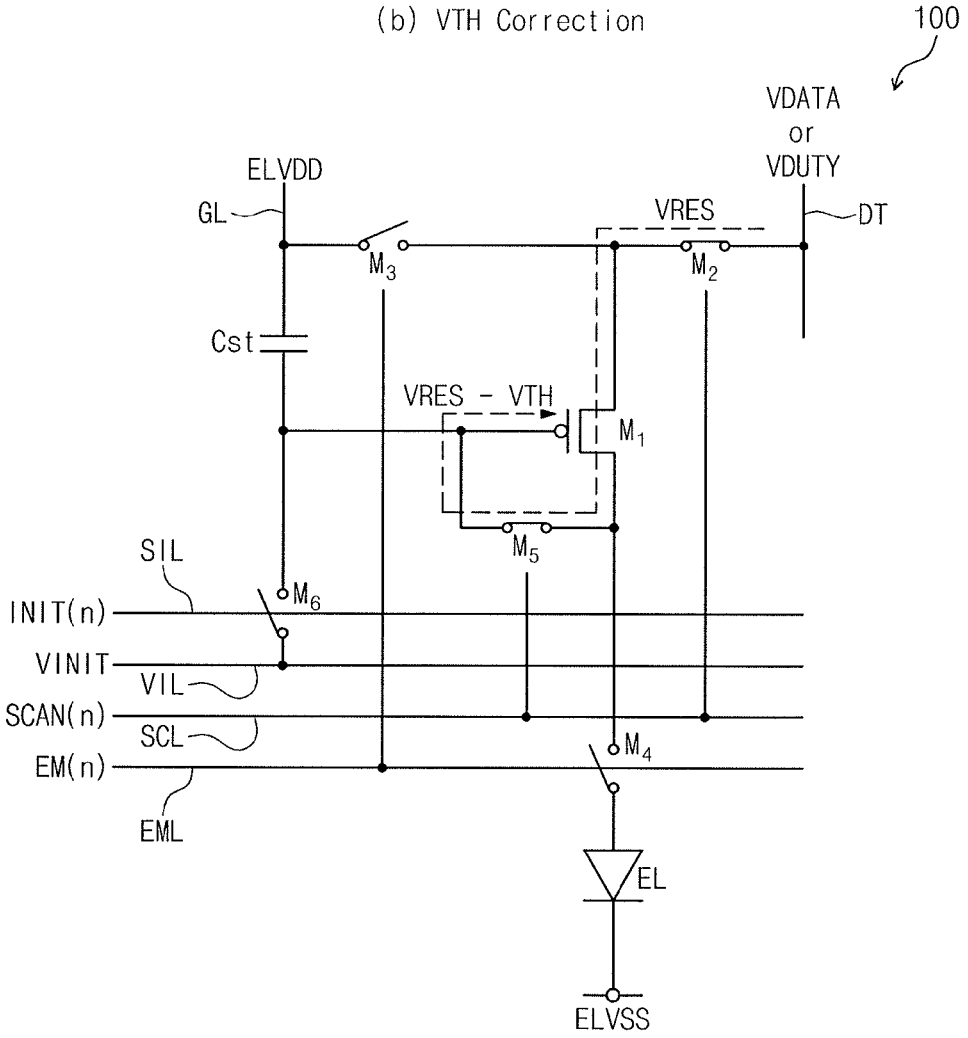

Referring to FIG. 19B, during the VTH correction period (b), the switch transistors $M_2$ and $M_5$ are turned on by a scan signal SCAN. The signal line DT receives a reference voltage VRES, and the driving transistor $M_1$ is diode-connected through the switch transistor $M_5$.

The reference voltage VRES is provided to the source terminal of the driving transistor $M_1$. At this time, the capacitive element Cst samples a voltage of (VRES-VTH), where VTH is the threshold voltage of the driving transistor $M_1$. At this time, VTH correction is performed. In this embodiment, the reference voltage VRES is lower than a data voltage VDATA.

Data Programming Period

Figure 19C:
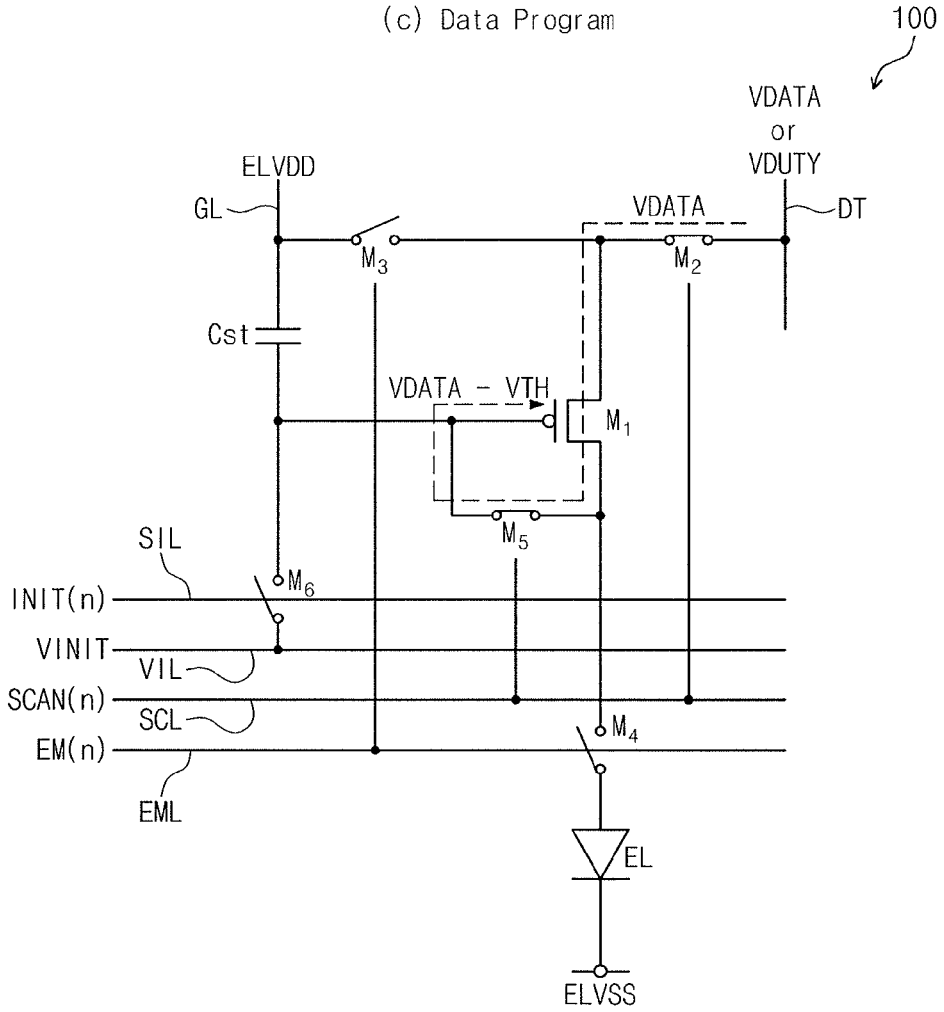

Referring to FIG. 19C, the data voltage VDATA corresponding to image data is provided to the source terminal of the driving transistor $M_1$ via the signal line DT. At this time, the capacitive element Cst samples a voltage (VDATA–VTH).

Duty Control Period

Figure 19D:
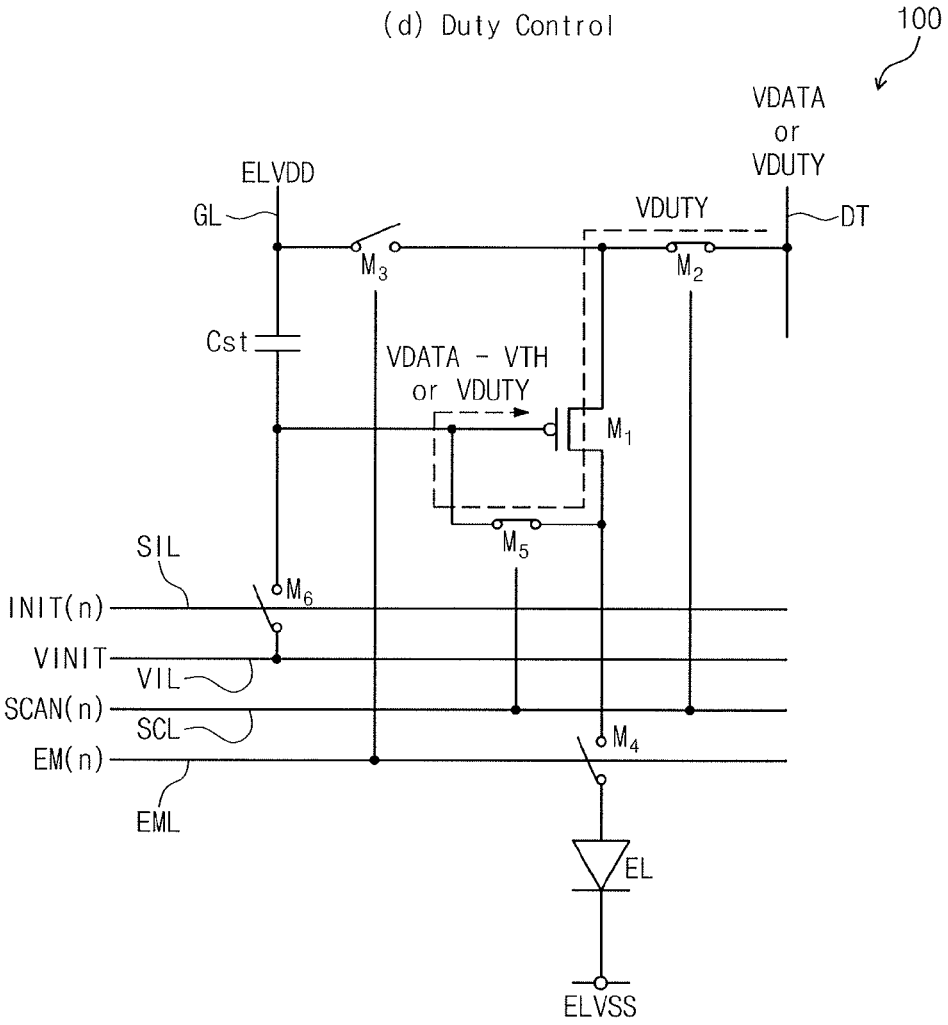

Referring to FIG. 19D, during the duty control period (d), the signal line DT receives a duty control voltage VDUTY. Two voltage values of the duty control voltage VDUTY are provided to the source terminal of the driving transistor $M_1$ according to display gray scale value, such that a light-emitting halt (high level) operation and a light-emitting continuance (low level) operation on the pixel circuit 100 are performed.

Light-Emitting Halt Period

Figure 19E:
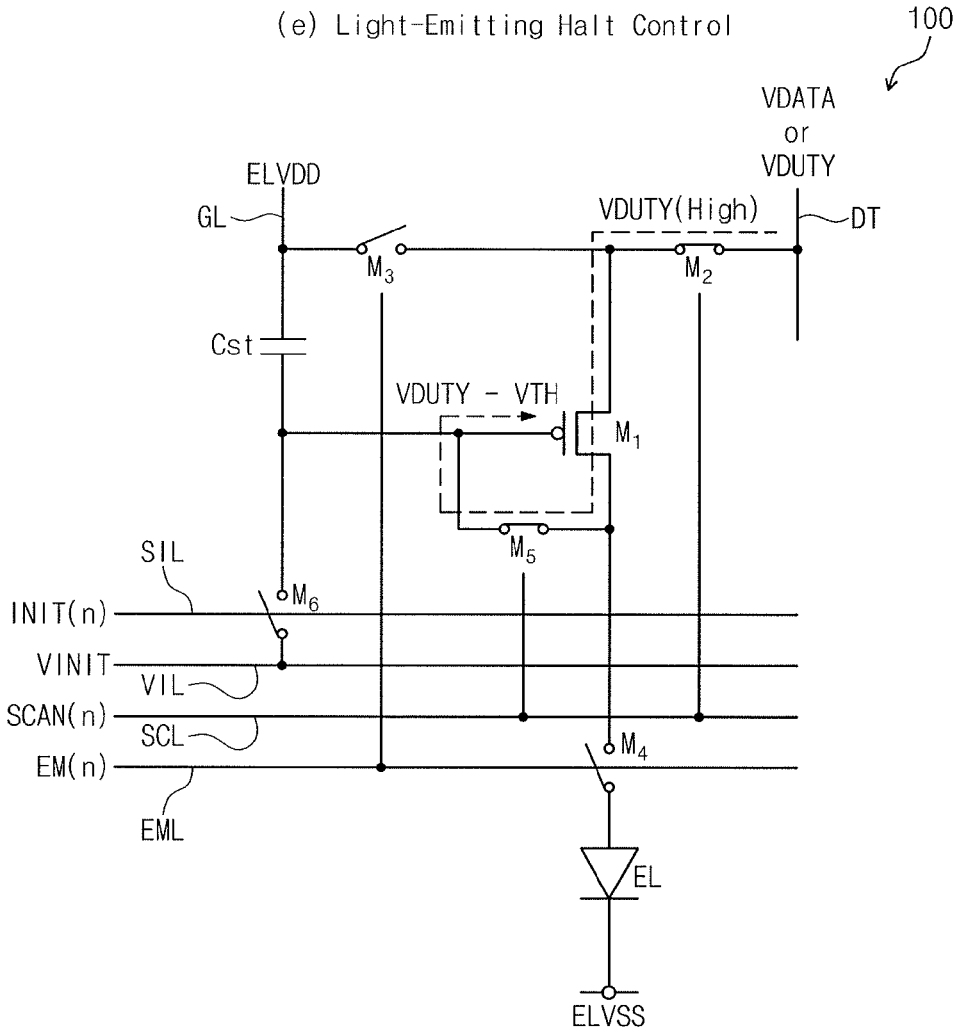

Referring to FIG. 19E, during the light-emitting halt period (e), the signal line DT receives a duty control voltage VDUTY of a high level. As a result, light-emitting of the EL element is stopped.

Light-Emitting Period

Figure 19F:
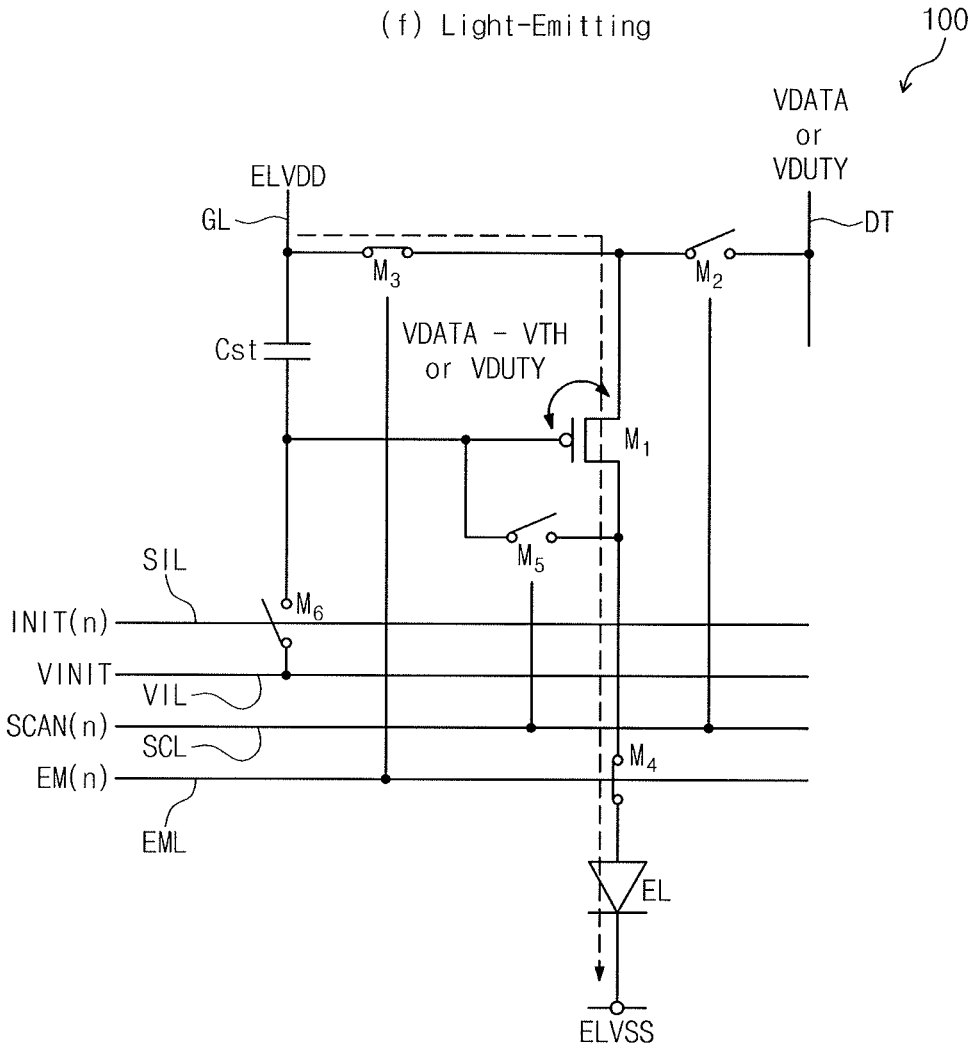

Referring to FIG. 19F, during the light-emitting period (f), the switch transistors $M_3$ and $M_4$ are turned on by a light-emitting control signal EM. Also, current that is controlled by the driving transistor $M_1$ is provided to the EL element. As a result, light-emitting of the pixel circuit 100 is controlled.

As illustrated in FIGS. 16 and 17, in the present embodiment, light-emitting of the EL element is stopped, and initialization and VTH correction are simultaneously performed with respect to all the pixel circuits 100. In the data programming period, a light-emitting operation is line-sequentially performed from a row where a data voltage VDATA has been written. Afterwards, duty period control is line-sequentially performed, and light-emitting is line-sequentially stopped.

Also, in this embodiment, because VTH correction is simultaneously performed for all pixels, it is possible to perform VTH correction for a sufficiently long time. Thus, the VTH correction capacity of the pixel circuits 100 may be improved.

As described above, an initialization control driver is not used because initialization is performed at the same time for all pixel circuits 100. As a result, it is possible to decrease the size of the EL display device 600. Also, because VTH correction is simultaneously performed for all pixels, it is possible to increase the VTH correction time. Thus, the VTH correction capacity of the pixel circuits 100 may be improved.

The methods, processes, and/or operations described herein may be performed by code or instructions to be executed by a computer, processor, controller, or other signal processing device. The computer, processor, controller, or other signal processing device may be those described herein or one in addition to the elements described herein. Because the algorithms that form the basis of the methods (or operations of the computer, processor, controller, or other signal processing device) are described in detail, the code or instructions for implementing the operations of the method embodiments may transform the computer, processor, controller, or other signal processing device into a special-purpose processor for performing the methods described herein.

Also, another embodiment may include a computer-readable medium, e.g., a non-transitory computer-readable medium, for storing the code or instructions described above. The computer-readable medium may be a volatile or non-volatile memory or other storage device, which may be removably or fixedly coupled to the computer, processor, controller, or other signal processing device which is to execute the code or instructions for performing the method embodiments described herein.

By way of summation and review, attempts have been made to correct (or, compensate) variation in the threshold voltages of the driving transistors. However, if the current supplied to each EL element decreases, for example, as a result of increasing display resolution, correction may not be achieved. In particular, non-uniformity in a displayed image may be intensified at low gray scale values (e.g., small current regions) because the characteristics of the EL elements substantially vary at these values. The degradation in luminance increases when maximum current supplied to the EL elements.

One approach which has been proposed to offset this performance degradation, changes the gate voltage of a pixel driving transistor to correct threshold voltage and to suppress variation in the drain current of the driving transistor. However, this approach makes it is difficult to control gray scale emissions at low gray scale values (small current region), especially when the amount of current supplied to an EL element decreases as a result in an increase in resolution. In particular, non-uniform display of images is intensified at low gray scale values (small current region) because of the characteristics of the EL element substantially varies at low gray scale values.

Another approach which has been proposed is to control pixels to emit light with different types of luminance levels using one gray scale display data. This approach may improve display non-uniformity at low gray scale values. This may be accomplished by changing a reference voltage between a first voltage and a second voltage to be supplied to each pixel. As a result, each pixel displays a gray scale value based on a sum of the amount of light-emission corresponding to the first voltage and the amount of light-emission corresponding to the second voltage.

However, changing the reference voltage in this manner for all pixels is disadvantageous for multiple gray scale values. Also, deterioration of image quality due to variation in threshold voltage Vth at low gray scale values may worsens for both of these approaches.

In accordance with one or more of the aforementioned embodiments, even though the amount of current to be provided to an EL element of a pixel circuit decreases to achieve high resolution, it is possible to suppress deterioration of image quality (e.g., non-uniformity) at low gray scale values.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An electroluminescence display device, comprising:

a plurality of pixel circuits, each of the pixel circuits including:

a light-emitting element to emit light based on a supplied current;

a driving transistor to supply the current to the light-emitting element based on a potential of a gate terminal of the driving transistor;

a sampling switch to sample a data voltage corresponding to image data at the gate terminal of the driving transistor;

a switch transistor to place the driving transistor in a diode-connected state; and a capacitive circuit to store a potential of the gate terminal of the driving transistor, wherein one vertical period in which each of the pixel circuits is driven includes a current gray scale control period and a duty gray scale control period, in the current gray scale control period the current to be supplied to the light-emitting element is controlled based on the data voltage, and in the duty gray scale control period a supplying period of the current provided to the light-emitting element is controlled based on a duty control voltage, wherein the data voltage and the duty control voltage are supplied to a source terminal of the driving transistor in the driving transistor diode-connected state, wherein the duty control voltage has two voltage values, and wherein the supplying period of the current provided to the light-emitting element is controlled based on different ones of the two voltage values of the duty control voltage, the supplying period when each of the pixel circuits is driven at a first gray scale value longer than that the supplying period when each pixel circuit is driven at a second gray scale, the first gray scale value being greater than the second gray scale value.

2. The device as claimed in claim 1, further comprising:

a plurality of control lines arranged in a row direction, the control lines to supply control signals for controlling transistors in respective ones of the pixel circuits; and a plurality of signal lines arranged in a column direction, the signal lines to supply data voltages and duty control voltages to respective ones of the pixel circuits, wherein:

the pixel circuits are arranged in a matrix and are connected to corresponding control lines and corresponding signal lines, operations which include initializing the gate terminal of the driving transistor and the potential of the capacitive element, correcting a threshold voltage of the driving transistor, programming data at the gate terminal of the driving transistor, and controlling a duty period of the driving transistor are line-sequentially performed for each of the pixel circuits, and a light-emitting timing and a non-light-emitting timing of the light-emitting element are different for the pixel circuits.

3. The device as claimed in claim 1, further comprising:

a plurality of control lines arranged in a row direction, the control lines to supply control signals for controlling transistors in respective ones of the pixel circuits; and a plurality of signal lines arranged in a column direction, the signal lines to supply data voltages and duty control voltages to respective ones of the pixel circuits, wherein:

the pixel circuits are arranged in a matrix form and are connected to corresponding control lines and corresponding signal lines, operations which include initializing the gate terminal of the driving transistor and the potential of the capacitive element and correcting a threshold voltage of the driving transistor are simultaneously performed for each of the pixel circuits, and operations of programming data at the gate terminal of the driving transistor and controlling a duty period of the driving transistor are line-sequentially performed for each of the pixel circuits, and a light-emitting timing and a non-light-emitting timing of the light-emitting element are different for the pixel circuits.

4. The device as claimed in claim 3, wherein the current gray scale control period is substantially equal to the duty gray scale control period.

5. The device as claimed in claim 3, wherein:

the duty gray scale control period includes a plurality of sub-frames, and the supplying period of the current provided to the light-emitting element based on the duty control voltage is controlled every sub-frame.

6. The device as claimed in claim 3, wherein the current gray scale control period is substantially equal to a period of each sub-frame of the duty gray scale control period.

7. A method for driving an electroluminescence display device, the method comprising:

controlling a current for a light-emitting element based on a data voltage and a supplying period of a current for the light-emitting element based on a duty control voltage, during one vertical period in which at least one pixel circuit is driven; and supplying the data voltage and the duty control voltage to a source terminal of a driving transistor of the at least one pixel circuit when the driving transistor is in a diode-connected state, wherein the duty control voltage has two voltage values, and wherein the supplying period of the current for the light-emitting element is based on different ones of the two voltage values of the duty control voltage, the supplying period when the at least one pixel circuit is driven at a first gray scale value is longer than the supplying period when the at least one pixel circuit is driven at a second gray scale value less than the first gray scale value.

8. The method as claimed in claim 7, further comprising:

supplying control signals for controlling transistors of a plurality of pixel circuits; and supplying data voltages and duty control voltages to the pixel circuits, the pixel circuits arranged in a matrix and connected to corresponding control lines and corresponding signal lines, the method further including:

line-sequentially performing operations which include initializing a gate terminal of the driving transistor and a potential of a capacitive element to store a potential of the gate terminal of the driving transistor, correcting a threshold voltage of the driving transistor, programming data at the gate terminal of the driving transistor, and controlling a duty period of the driving transistor for each of the pixel circuits, wherein a light-emitting timing and a non-light-emitting timing of light-emitting elements of the pixel circuits are different.

9. The method as claimed in claim 7, further comprising:

supplying control signals for controlling transistors in a plurality of pixel circuits; and supplying the data voltage and the duty control voltage to each of the pixel circuits, the pixel circuits arranged in a matrix and connected to corresponding control lines and corresponding signal lines, the method further including:

simultaneously performing operations which include initializing a gate terminal of the driving transistor and a potential of a capacitive element to store a predetermined potential of the gate terminal and correcting a threshold voltage of the driving transistor for each of the pixel circuits, and line-sequentially performing operations which include programming data at the gate terminal of the driving transistor and controlling a duty period of the driving transistor for each of the pixel circuits, wherein a light-emitting timing and a non-light-emitting timing of the light-emitting element are different for the pixel circuits.

10. The method as claimed in claim 9, wherein:

one vertical period in which each of the pixel circuits is driven includes a current gray scale control period and a duty gray scale control period, in the current gray scale control period, the current to be supplied to the light-emitting element is controlled based on the data voltage, in the duty gray scale control period a supplying period of the current provided to the light-emitting element is controlled based on a duty control voltage, and the current gray scale control period is substantially equal to the duty gray scale control period.

11. The method as claimed in claim 9, wherein:

one vertical period in which each of the pixel circuits is driven includes a current gray scale control period and a duty gray scale control period, in the current gray scale control period, the current to be supplied to the light-emitting element is controlled based on the data voltage, in the duty gray scale control period a supplying period of the current provided to the light-emitting element is controlled based on a duty control voltage, and the duty gray scale control period includes a plurality of sub-frames, and the supplying period of the current provided to the light-emitting element based on the duty control voltage is controlled every sub-frame.

12. The method as claimed in claim 9, wherein:

one vertical period in which each of the pixel circuits is driven includes a current gray scale control period and a duty gray scale control period, in the current gray scale control period, the current to be supplied to the light-emitting element is controlled based on the data voltage, in the duty gray scale control period a supplying period of the current provided to the light-emitting element is controlled based on a duty control voltage, and the current gray scale control period is substantially equal to a period of each sub-frame of the duty gray scale control period.

13. An apparatus, comprising:

an interface; and a controller coupled to the interface, the controller to control at least one pixel circuit during a first period and a second period, wherein the controller is to control current to a light-emitting element of the at least one pixel circuit based on a data voltage in the first period, wherein the controller is to control a supplying period of current to the light-emitting element based on a duty control voltage in the second period, and wherein the supplying period is controlled based on different voltage values of the duty control voltage, the supplying period when the pixel circuit is driven at a first gray scale value is longer than that when the pixel circuit is driven at a second gray scale, the first gray scale value being greater than the second gray scale value.

14. The apparatus as claimed in claim 13, wherein the data voltage and the duty control voltage are supplied to a source terminal of a driving transistor of the pixel circuit when the driving transistor is in a diode-connected state.

15. The apparatus as claimed in claim 13, wherein the first period is substantially equal to the second period.

16. The apparatus as claimed in claim 13, wherein the first period is substantially equal to a period of a sub-frame in the second period.

17. The apparatus as claimed in claim 13, wherein the controller is to line-sequentially control operations which include:

initializing a gate terminal of a driving transistor and a potential of a capacitive element of the at least one pixel circuit, correcting a threshold voltage of the driving transistor, programming data at the gate terminal of the driving transistor, and controlling a duty period of the driving transistor.

18. The apparatus as claimed in claim 13, wherein:

the at least one pixel circuit includes a plurality of pixel circuits, and a light-emitting timing and a non-light-emitting timing are different for the pixel circuits.

19. The apparatus as claimed in claim 13, wherein:

the controller is to simultaneously control operations which include initializing a gate terminal of a driving transistor and a potential of a capacitive element, and correcting a threshold voltage of the driving transistor of each of a plurality of pixel circuits, and the controller is to line-sequentially control operations which include programming data at the gate terminal of the driving transistor and controlling a duty period of the driving transistor of each of the pixel circuits.

20. The apparatus as claimed in claim 13, wherein:

the second period includes a plurality of sub-frames, and the supplying period of the current to the light-emitting element based on the duty control voltage is controlled every sub-frame.

* * * * *